United States Patent [19]

Tilman

[11] 4,215,253

[45] Jul. 29, 1980

[54] HIGH DIRECT AND ALTERNATING CURRENT SWITCH

[76] Inventor: Ted N. Tilman, 3538 Telegraph Dr., San Jose, Calif. 95132

[21] Appl. No.: 974,061

[22] Filed: Dec. 28, 1978

[51] Int. Cl.[2] ..... H01H 35/38

[52] U.S. Cl. ..... 200/82 R; 200/16 B; 200/153 S; 200/164 R; 200/255; 200/288

[58] Field of Search ..... 200/17 R, 18, 16 R, 200/16 A, 16 B, 16 C, 81 R, 82 R, 82 B, 146 R, 148 R, 153 A, 153 B, 153 D, 153 S, 164 R, 164 A, 239, 243, 252, 255, 260, 288, 245, 163

[56] References Cited

U.S. PATENT DOCUMENTS

| | | | |
|---|---|---|---|
| 3,073,932 | 1/1963 | Schulz | 200/82 B |
| 3,224,447 | 12/1965 | Becker et al. | 200/16 B |
| 3,244,843 | 5/1966 | Ross | 200/146 R |
| 3,855,436 | 12/1974 | Marin | 200/146 R |
| 3,941,957 | 3/1976 | Tilman | 200/82 R |

*Primary Examiner*—Gerald P. Tolin
*Attorney, Agent, or Firm*—John J. Leavitt

[57] ABSTRACT

Presented is a high power switch for making, breaking and carrying high direct and alternating current circuits. The switch incorporates pairs of contacts that operate in sequence, one of the contact pairs being the first to "make" and the last to "break" and the other contact constituting a movable conductive bridge to carry the primary load through the switch structure.

37 Claims, 24 Drawing Figures

HIGH DIRECT AND ALTERNATING CURRENT SWITCH

BACKGROUND OF THE INVENTION

1. Field of the Invention

This invention relates to electric switches, and particularly to high power electric switches having an enclosed envelope and suitable for making, breaking and carrying high levels of direct current in the order of 25,000 amperes.

2. Description of the Prior Art

It is believed the prior art relating to the subject matter of this invention may be found in Class 200, sub-classes 82R; 16B; 153S and 255. Additionally, art pertaining to this invention is believed to reside in Class 335, sub-classes 182, 183 and 184. The inventor herein is the inventor named in U.S. Pat. No. 3,941,957 and is aware of and hereby notes and includes herein by reference the reference patents cited in that patent.

The prior art is repleat with switches of various designs. For instance, the inventor herein joined in the conception and design of the devices taught in U.S. Pat. No. 3,368,049 entitled High Current Radio Frequency Switch, and U.S. Pat. No. 3,394,324 entitled Coaxial Switch. Additionally, the inventor herein is the inventor named in U.S. Pat. No. 3,941,957. The switches forming the subject matters of these patents, with the exception of U.S. Pat. No. 3,941,957, and many conventional switches have incorporated a vacuum envelope within which the contacts make and break a circuit through the switch. The inventor herein has pioneered vacuum type radio frequency switches such as exemplified by the above noted patents and U.S. Pat. No. 3,261,953. One disadvantage inherent in a vacuum switch is that the cost of processing the vacuum switch tends to be prohibitive. Accordingly, it is one of the objects of the present invention to provide an electrical device in the nature of a switch which is capable of making, breaking and carrying high levels of direct electrical current without the necessity of providing a vacuum envelope.

Additionally, because the atmosphere within the sealed envelope constitutes a high vacuum, it is especially difficult to achieve movement of parts relative to one another within the vacuum envelope without a certain amount of galling. The reason for such galling is that the surfaces of the metallic parts within a vacuum switch are so clean and free from oxidation that two metal parts that come together tend to stick and weld together and resist relative movement. On the other hand, prior to my innovations, particularly the innovations described in U.S. Pat. No. 3,941,957, it was not practicable within the state of the art to produce a radio frequency switch that had the voltage standoff characteristics required for wide applicability without using a vacuum envelope. Additionally, vacuum switches are physically fragile and not susceptible to connection with high power busses. Accordingly, a still further object is the provision of a non-vacuum switch structure that is rugged and well suited to connection to heavy, high current busses.

With respect to high levels of direct and alternating current, it has not heretofore been practical to make, break or carry such direct and alternating currents because of the tendency of the switch contact to arc in both the "make" and "break" modes, because of the excessive heat generated when the switch is in a "carry" configuration, and because of the inherent danger surrounding the installation and operation of such switches. Accordingly, another object of the present invention is to provide a switch structure capable of effectively handling high levels of direct and alternating current without the danger of arcing, or the disadvantage of heating, or the inability to carry high levels of current in the order of 25,000 amperes.

Another of the disadvantages of conventional vacuum switches is that these switches require the use of an external actuator to effect transfer or movement of the contact within the envelope. The use of external actuators has run the gamut from hydraulic to air, to solenoids, and to mechanical linkages adapted to effect transfer of the movable contact within the envelope. All such external actuators have required the utilization of a deformable vacuum type wall in the nature of a flexible bellow or diaphram interposed between the movable contact and the actuating mechanism. Where a solenoid has been used, it has been necessary to provide a vacuum tight seal between the coil structure of the solenoid and the armature thereof on which, or in association with which, is mounted the movable contact within the vacuum envelope portion of the switch. The use of such vacuum tight sealing methods and materials has required the utilization of special skills and fabrication techniques which contribute to the prohibitive cost of such devices. Accordingly, it is another object of this invention to provide a switch structure in which the contact element makes and breaks a circuit within a fluid medium rather than in a vacuum.

So far as is known, a switch structure has not been patented or successfully used in which two movable electrically conductive members are provided within a sealed but not vacuum envelope with one of those movable members functioning to make or break a circuit between associated terminal members and therefore appropriately constituting a "contact", and the other movable member constituting a conductive bridge or shunt in relation to the movable contact member to provide two paths for current flow through the switch. Both of the movable members constitute pistons mounted for displacement between switch "open" and switch "closed" positions by the imposition of fluid pressure applied directly to the pistons within the envelope. Accordingly, it is a still further object to this invention to provide a switch structure particularly suitable for high levels of direct and alternating current in which movement of the make or break contact and current conductive bridging elements is controlled by direct application of fluid pressure thereto.

In the operation of high level direct and alternating current switchgear, one of the forces that tends to "open" the switch contacts of such switchgear, thus increasing the contact resistance, and thereby lowering the current carrying capacity thereof, is the magnetic field that surrounds the switch contacts and tending to drive them apart. Accordingly, another object of the present invention is the provision of a switch structure that effectively cancels the magnetic field effect that tends to drive the contacts apart when the switch is in a current "carry" mode.

The susceptability of switches to arcing between relatively movable members is well known. This is particularly true in a switch which is utilized in high current applications. One of the factors that initiates such arching is contact "bounce" upon closing of the switch at high closing velocities. Accordingly, it is another object of the present invention to provide a high direct current switch incorporating a contact assembly and method of actuation thereof which incorporates a built in resilience and resistance to contact bounce, thus reducing or eliminating the tendency of the contact to generate an arc.

Among the factors that determine the circuit breaking characteristics of a switch is the efficiency with which heat generated in the contact elements is dissipated. It is well known that permitting the contact element to operate at elevated temperatures increases the electrical resistance and thus lowers the current carrying capacity of the switch. This problem has been partially solved in the art by fabricating the movable contact member of material possessing a large mass, the thought being that such large mass functions as a heat sink. This solution however introduces a new problem, namely, an increase in the inertial force when the switch contact of large mass moves at high velocity from one position to another. Such high inertial force contributes to contact bounce and to arcing between the contact surfaces. Accordingly, it is yet another object of the present invention to provide a contact assembly for a high direct and alternating current switch in which the contact assembly includes a piston movable between requisite positions by the direct imposition of fluid pressure thereon, which also serves to absorb and convey away a large proportion of the heat from the switch contact, and which works in conjunction with a piston-like highly conductive bridge member that provides a multiplicity of short current-carrying paths between the terminals to thereby increase the current-carrying capacity of the switch.

In prior art switches touted as "no bounce" switches, one of the contact members is usually stationary while the movable contact is mounted on an appropriate support which also functions as the means for moving the contact. Such means frequently constitutes a slide bearing and a spring. One of the reasons why such prior art switches do not successfully achieve a "no bounce" condition is that there is no appreciable resilience in the stationary contact, so that when the movable contact impinges against the stationary contact at high velocity, there is no means provided to prevent the contacts from bouncing apart. Accordingly, another object of the present invention is the provision of means associated with both of the "make" and "break" contact members in a high level direct and alternating current switch to completely eliminate bounce between the contacts.

One of the limiting factors in connection with high radio frequency switches is the "skin effect" as frequencies increase, which may be described as limiting the current carrying capacity of the conductor to the peripheral surface thereof as distinguished from its cross-sectional area. The opposite is generally true with direct and low alternating current conductors, the effectiveness of the conductor and its current carrying capacity being determined by its cross-sectional area. This factor has been one of the limitations in high level direct and alternating current switches for the reason that there has been a practical limit to the diameters of current carrying members that could be used in conventional direct and alternating current switches. Accordingly, another object of the present invention is the provision of means to increase the effective cross-sectional area of the conductors in a direct and low alternating current switch so as to increase to a surprising level the current carrying capacity of the switch. For instance, because of the technological break-through presented herein current levels of 25,000 amperes and above now appear to be routinely possible because of the novel structure described herein.

It is sometimes difficult in an art such as the one here involved to explain why a specific structure such as herein described operates in the way that it does, while a somewhat similar yet conventional structure, with seemingly small differences in mechanical configuration and mode of operation will not operate by the same mode nor to the expected level. This phenomenon has been encountered in the development of the switch forming the subject matter of this invention. It can be affirmed that, surprisingly, the switch structure illustrated and described herein has surpassed a current carrying capacity of 25,000 amps. continuous and has successfully closed in on a circuit carrying such amperage and interrupted such high levels of amperage without generation of destructive arcs.

Conventional direct and low alternating current switches have attempted to eliminate the arcing problem by designing contact structures that will automatically extinguish an arc after it has formed. One of the objects of the present invention is the provision of a switch structure for direct and alternating current loads that prevents such as arc from forming so that the problem of extinguishment of the arc is eliminated.

Still another object of the invention is the provision of a high level direct and alternating current switch which possesses a total resistance when closed of only about 1.6 micro-ohms at a temperature of approximately 160° F..

A still further object of the present invention is the provision of a high level direct and alternating current switch incorporating a sealed envelope enclosing therewithin movable members forming electrical conductors that move at a predetermined velocity under the impetus of a predetermined fluid pressure differential to effect closing or opening of the switch without the generation of a destructive arc.

A still further object of the present invention is the provision of a method of operating a switch structure of the type described to achieve a high current carrying capacity without generation of destructive arcs.

Still another object of the invention is the provision of a high current carrying contact strip for use in high energy switch structures.

Another object is the provision of means in a high level switch structure for effecting rotation of large diameter current carrying members to eliminate galling of the contact surfaces thereof.

Yet another object of the invention is the provision of a switch structure in which resiliently biased contact bars are periodically relieved of bias to increase their life expectancy and efficiency.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the air-actuated high direct and alternating current switch of the invention in one of its aspects comprises a hollow envelope formed from a pair of oppositely disposed axially aligned hollow metallic terminal members retained in spaced relationship by a dielectric envelope sleeve. Within the envelope the spaced terminal members provide cylindrical contact surfaces incorporating a multiplicity of longitudinally extending resilient contact bars arranged in a circumferential array. On one of the terminal members there is supported a piston-like bridge member in continuous electrically conductive contact with the associated terminal and movable into electrically conductive contact with the opposite terminal member by the differential of fluid under pressure contained within designated chambers within the envelope on opposite sides of the piston-like bridge member. Additionally, the piston-like bridge member incorporates a contact button movable with the bridge member into electrically conductive engagement with a corresponding contact button electrically conductively and mounted on the opposite terminal member in a manner to be normally resiliently biased into a contact "make" relationship with the other contact button. The switch structure is operated in a "make" mode by varying the pressures in the chambers on opposite sides of the movable bridge member to create a pressure differential whereupon the bridge member moves in the direction of the lower pressure to complete a circuit between the terminal members. Such circuit is first completed through the movable "make" and "break" contact button mounted on the bridge member and movable with it and the complementary contact member resiliently mounted on the opposite terminal member. Continued movement of the bridge member after initial contact of the contact buttons to complete a circuit between the terminal members effects engagement of the bridge member with the opposite terminal member so as to augment the total current carrying capacity of the switch.

When the switch is operated in an "open" mode, i.e., when the circuit is "broken", the pressure levels in the chambers is adjusted so that greater pressure exists on the "closed" end of the switch, resulting in movement of the bridge member out of engagement with one of the terminal members while maintaining conductive contact between the two contact buttons for a finite interval after the bridge member is disconnected from the opposing terminal member to terminate conduction of current therethrough, with subsequent continued movement of the bridge member and the contact buttons effecting disengagement or parting of the "break" contacts within a pressurized atmosphere and at a velocity so as to prevent arcing therebetween upon separation thereof.

DESCRIPTION OF THE PREFERRED EMBODIMENT

Figure 4:
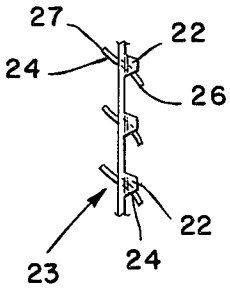
FIG. 4 is an enlarged fragmentary elevational view of a segment of the current carrying resilient contact bar strip apart from any other structure.
Figure 5:
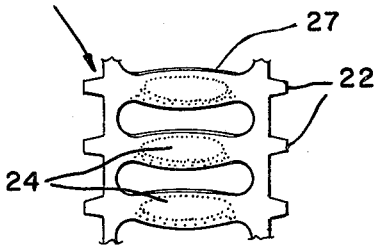
FIG. 5 is a fragmentary view of the resilient contact bar strip of FIG. 4, apart from any other structure.
Figure 6:
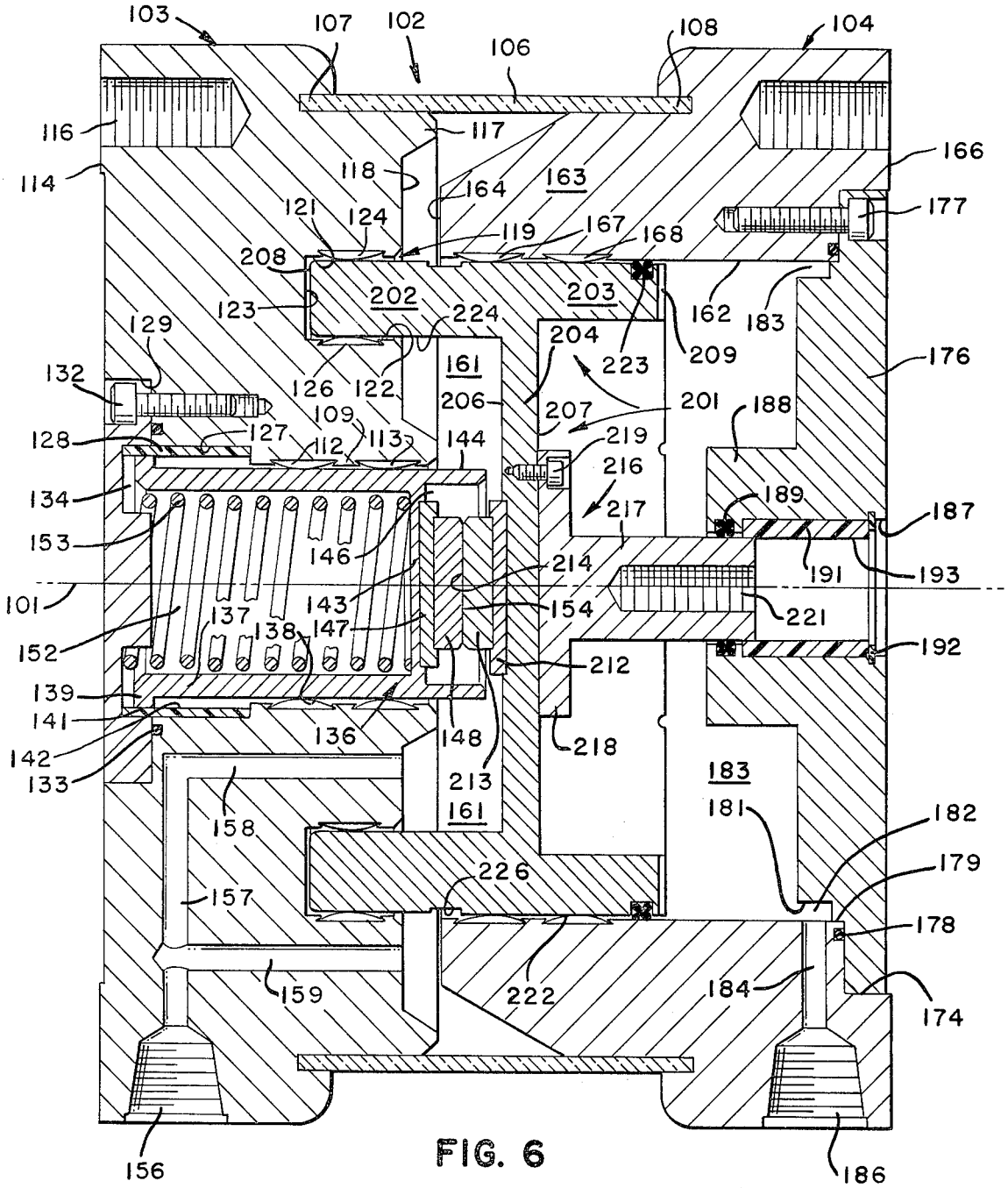
FIG. 6 is a cross-sectional view through the central axis of a second embodiment of the invention in a high current switch structure. The movable electrically conductive members within the envelope are illustrated in a current carrying configuration.
Figure 9:
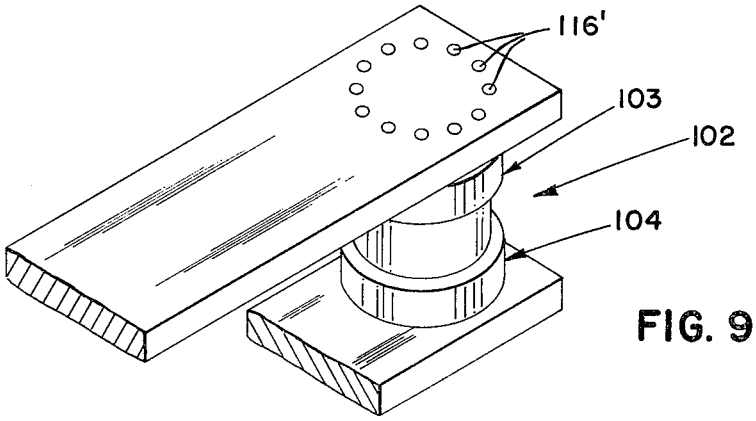
FIG. 9 is a perspective view in reduced scale illustrating the manner in which the switch is interconnected with outside terminal busses.
Figure 7:
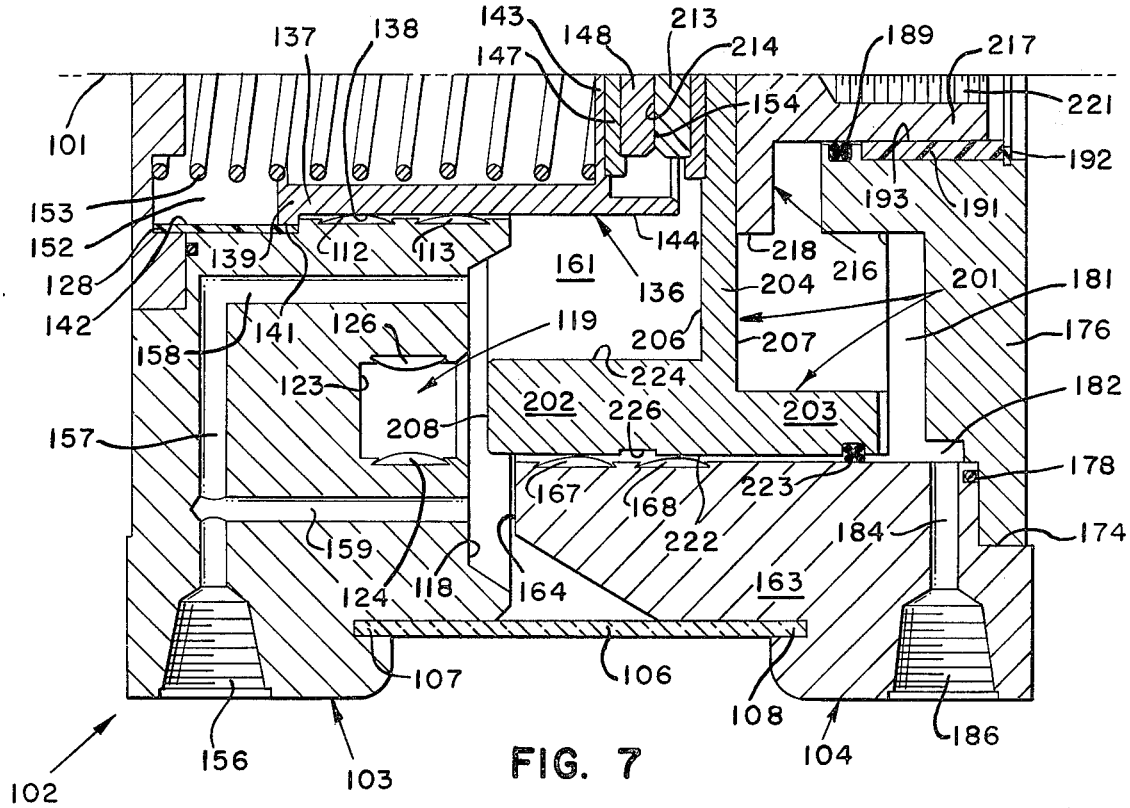
FIG. 7 is a partial cross-sectional view through the central axis showing one half of the structure illustrated in FIG. 6, but illustrating the movable electrically conductive members within the envelope in an intermediate position in which the primary current carrying bridge member has disengaged from one of the terminal members while the make-break contacts still remain in electrically conductive contact with one another just prior to separation thereof by continued movement of the bridge member to the right as viewed in FIG. 7.
Figure 8:
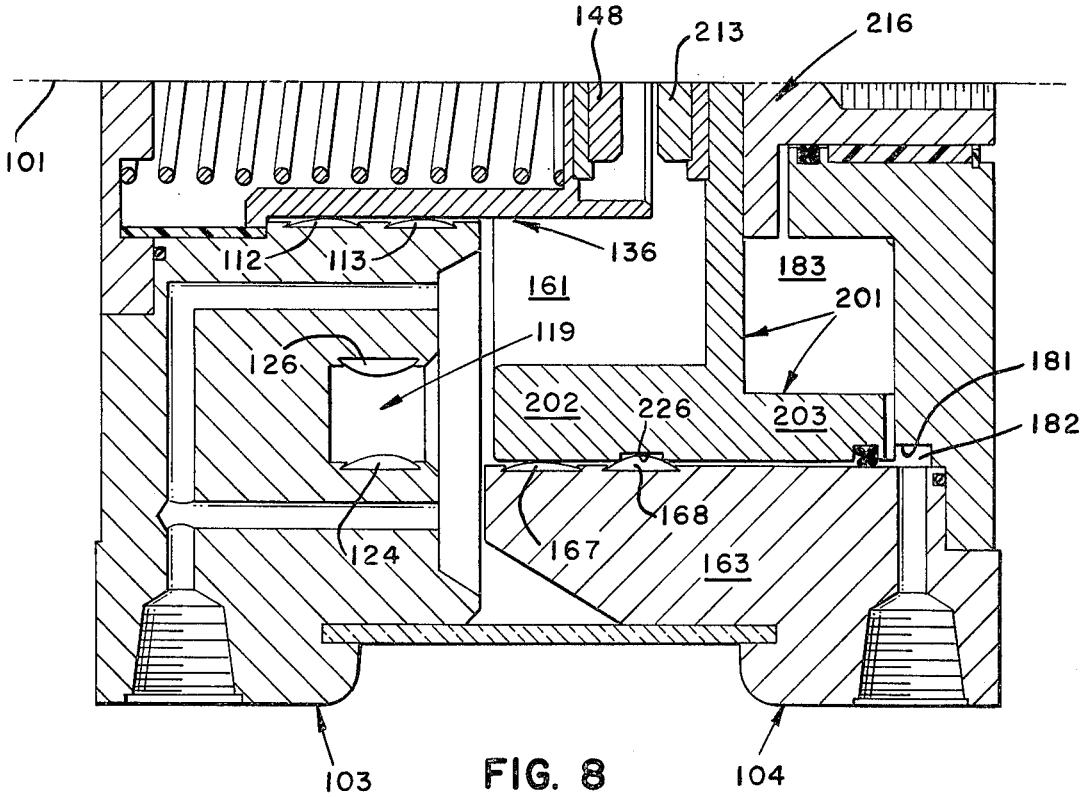
FIG. 8 is a view similar to FIG. 7 but showing the electrically conductive movable members within the envelope separated from corresponding contact surfaces on the opposite terminal member to establish an "open" switch configuration in which no current flows through the switch.
Figure 14:
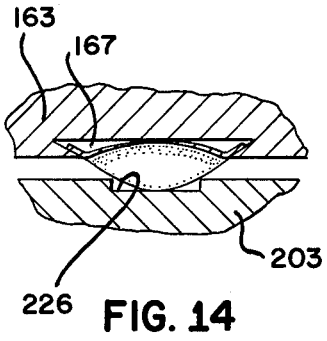
FIG. 14 is a view similar to FIG. 13 but showing the contact bars in an unstressed or unbiased condition.
Figure 15:
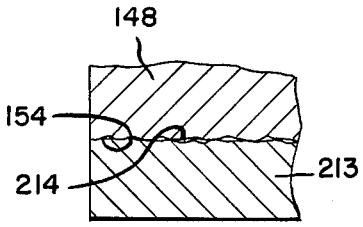
FIG. 15 PRIOR ART
FIG. 15 is an enlarged fragmentary sectional view showing in exaggerated scale the effect of the uneveness of contact surfaces in limiting current carrying capacity.
Figure 16:
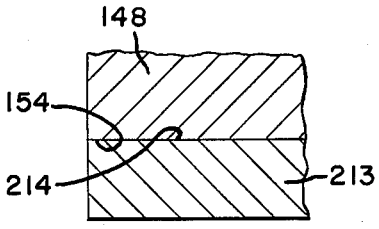
FIG. 16 is a view similar to FIG. 15, but showing the contacts greatly magnified to illustrate the "melt" that occurs between the contacts in the present invention.

In terms of greater detail the direct and alternating current switch of the invention comprises in one of its aspects the switch structure illustrated in FIGS. 1 through 5, and in another aspect the switch structure illustrated in FIGS. 6 through 8. The manner of mounting the completed switch is illustrated in FIG. 9, and a complete understanding of the mode of operation of the switch may be had from a careful review of the graphs illustrated in FIGS. 17 through 20 in connection with the "make" mode of operation of the switch, and by reviewing FIGS. 21 through 24 with respect to the "break" mode of operation of the switch. Additionally FIGS. 10–14, inclusive illustrate a novel contact bar assembly, while FIGS. 15 and 16 compare the mode of operation of a conventional contact (FIG. 15) with the mode of operation of the "make" and "break" contact in the instant case.

At first glance it may seem that the structures illustrated in FIGS. 1–9 and described herein are quite simple. And they are. However, when the simplicity of construction is measured against the object to be obtained, namely, the capacity to carry 25,000 amps of direct or alternating current without undue temperature increase, and the ability to make and break such current loads without causing any arcing or destruction of the switch, and to accomplish all of this in an envelope that is not a vacuum envelope, and which is only approximately 6 inches in length and about 8 inches in diameter, in contrast to conventional equipment for carrying 25,000 amps and for making and breaking such current loads, many of which are the size of a full size office desk, it is most surprising that a structure as small and as "simple" in its construction can perform in the way that it does. The fact that it does so perform is attributed to what is believed to be a most significant and surprising breakthrough in switch gear technology.

The breakthrough is believed to encompass design of structure and mode of operation so as to eliminate "bounce" between the contacts in the "make" mode of operation of the switch and is achieved by reducing and controlling the velocity of the movable contact rather than increasing the velocity of the movable contact as is commonly thought to be the answer to the "bounce" problem in conventional high power switch gear.

It has been found that if a contact assembly can be actuated to "make" a circuit through the switch even at very heavy current loads without causing "bounce" between the impacting contact points or buttons, the current load going through the switch will rise very rapidly through the "make" contact buttons until it is carrying full load. In the switch structure illustrated, this time lapse amounts to approximately 1½ milliseconds, and occurs with a substantially constant rate of movement, imposed by a substantially constant pressure differential. From the graphs, particularly FIG. 18, it will be seen that during the same period that current is rising, the pressure imposed between the mated contact buttons is also rising in a linear or parallel fashion so as to prevent the natural magnetic field generated by the passage of current through the assembly from separating the contact buttons and thus causing an arc to form. Not only do the contact buttons not separate, the pressure between the contact buttons does not fluctuate but continues increasing steadily until it reaches a maximum figure.

During this interval of increasing current with increasing pressure, an additional current carrying bridge member is moving into electrically conductive engagement with the opposite terminal member of the switch so as to provide a second path for current flowing through the switch. The configuration of the bridge member is designed to effectively cancel out or minimize the effect of magnetic fields which would normally tend to "open" the switch, thereby facilitating retention of the switch in a closed condition at a substantially lower overall pressure.

Figure 1:
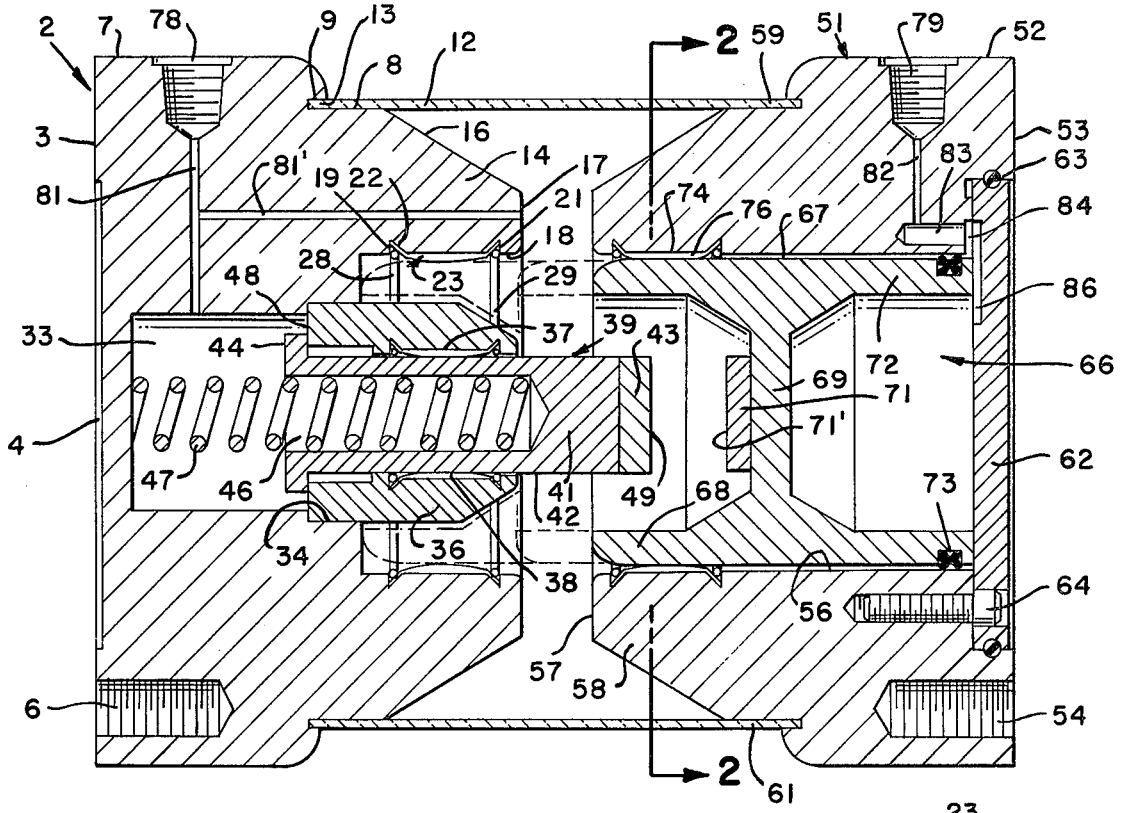
FIG. 1 is a vertical cross-sectional view through one embodiment of the invention in a high current switch structure.

Referring now to FIG. 1, in the embodiment there disclosed, the switch structure comprises a terminal member designated generally by the numeral 2 and including a connector face 3 provided with a recess 4, and provided also with a multiplicity of bores 6, preferably 12 in number arranged in a circumferential array and equally spaced about the face 3 for purposes which will hereinafter be described. The terminal member 2 is preferably fabricated from high conductivity aluminum, preferably 6,000 series, and presents a circular periphery 7 which merges integrally into a reduced diameter portion 8 which terminates at one end in an annular groove 9 formed in the terminal member to sealingly receive a cylindrical sleeve 12 fabricated from high strength dielectric material the end portion 13 of which is seated in the groove 9. Concentrically projecting into the cylindrical sleeve 12 is an annular electrically conductive nose portion 14 defined by an outer inclined surface or periphery 16 and an end face 17 lying substantially parallel to the face 3 of the terminal member and spaced somewhat to the left of a median plane extending through the switch structure.

Figure 3:
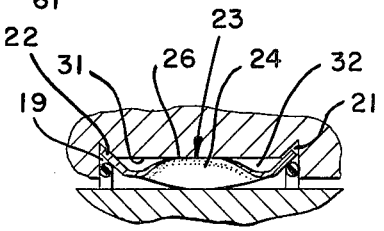
FIG. 3 is a fragmentary cross-sectional view in an enlarged scale illustrating the longitudinally extending resilient contact bars interposed between the movable current carrying members within the switch and the fixed terminal members.
Figure 2:
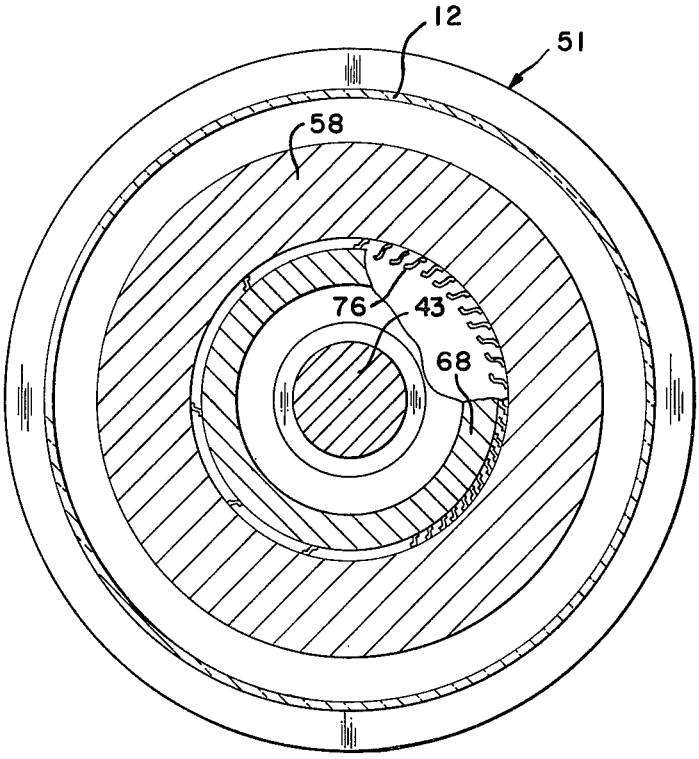
FIG. 2 is a transverse cross-sectional view taken in the plane indicated by the line 2—2 in FIG. 1.

The inner periphery 18 of the nose portion 14 is provided with spaced parallel grooves 19 and 21 adapted to receive the projecting edge members 22 of a contact strip 23, the contact strip including a multiplicity of resilient bar members 24 spaced apart along the strip and twisted as illustrated in FIGS. 3 and 4 to provide side edges 26 and 27 on each of the resilient bars 24 for use in a manner which will hereinafter be explained.

As illustrated in FIG. 1, the contact strip 23 is formed into a circular configuration so as to conform to the inner periphery 18 of the inwardly projecting nose portion 14 of the terminal member and the strip is retained in the grooves 19 and 21 by application of appropriate snap rings 28 and 29. In this position of the contact strip, the resilient contact bars 24 lie parallel to the longitudinally extending axis of the switch, with one of the edges 26 (FIG. 3) resiliently abutting the bottom surface 31 of groove 32 within which the contact strip is trapped.

Also formed in the terminal member 2 is a recess 33 coaxially disposed with respect to the longitudinal axis of the switch and terminal member in which it is formed, and opening into the recess formed by the inner periphery 18 formed in nose portion 14 of the terminal member. Seated in the rabbetted edge portion 34 of the bore 33 is an annular bearing member 36 the base of which is suitably silver brazed into the rabbet 34 so that the annular bearing 36 projects into the envelope in a coaxial relationship about the central axis thereof to provide an inner peripheral groove 37 within which is trapped a contact strip 38 similar to the contact strip 23.

Mounted on the bearing member 36 is a movable contact structure designated generally by the numeral 39 and including a body portion 41 the outer periphery 42 of which is cylindrical and adapted to electrically conductively engage the axially extending resilient contact bars 24' of the contact strip 38 so that the movable contact body 41 may reciprocate in a manner which will hereinafter be explained. At one end the movable contact body is provided with a contact button 43 while at the other end, the movable contact body is provided with a radially extending flange 44 and a central bore 46 adapted to receive a heavy coil compression spring 47 as shown. The spring extends into the bore 46 and resiliently presses the contact body 41 to the right as illustrated in FIG. 1. Movement of the contact body to the right is snubbed by the radially extending flange 44 impinging against the bottom surface 48 of the bearing member 36. In this position of the movable contact body 41, the contact button 43 is in the extreme position of travel in one direction so that the contact face 49 is at the farthest distance from the face 3.

At the opposite end of the switch structure, the switch is provided with a terminal member designated generally by the numeral 51, having a cylindrical periphery 52, end face 53, and a circular array of twelve internally threaded bores 54 by which a terminal lead is attached to the terminal member. The terminal member is annular in its configuration, having an inner periphery 56 extending from the end face 53 to the inner face 57 of nose portion 58 which projects into the envelope in the same manner as nose portion 14 of terminal member 2. As shown, the opposite end portion 59 of the dielectric sleeve 12 is appropriately sealed to the cylindrical surface 61 of the terminal member to thus rigidly retain the two terminal members in axially aligned and spaced relation. The inner periphery 56 constitutes a coaxial bore which adjacent the face 53 is relieved to provide a shoulder or seat as shown to receive an end plate 62 provided with an annular "O" ring seal 63 to seal the union between the end plate and the terminal member against the ingress or egress of air from the envelope. The end plate is securely fastened to the terminal member by a multiplicity of cap screws 64 as shown.

Within the cylindrical bore formed by the inner periphery 56 of terminal member 51, there is provided a movable current carrying bridge member designated generally by the numeral 66. Viewed in elevation, the bridge member 66 is cylindrically symmetrical about the longitudinal axis of the envelope and coaxially arranged with respect to the movable contact body 41. As illustrated, the movable electrically conductive bridge member is provided with a cylindrical outer periphery 67 which lies radially spaced from the inner peripheral surface 56 of the associated terminal member but coaxial therewith, and when viewed in longitudinal cross-section has a generally H-shaped configuration formed by a cylindrical skirt 68 at one end of the bridge member, a transverse wall 69 on which is brazed a contact button 71 having a contact surface 71' for engagement with the contact surface 49 on contact button 43 of the movable contact assembly or body 41, and a second electrically conductive cylindrical skirt portion 72 on the opposite side of the transverse wall 69 from the skirt 68. The latter skirt portion 72 is provided with an annular groove in its outer periphery adjacent the end thereof remote from the transverse wall to receive a "quad" ring sealing member 73 therein for sealing the annular space between the outer periphery 67 of the bridge member and the inner periphery of the bore 56 for purposes which will hereinafter be explained.

To provide a high level of electrical conductance between the movable bridge member 66 and the associated terminal member 51 on which it is slidably supported and electrically conductively related at all times, there is provided in the nose portion 58 of the terminal member, retained in a groove 74, an elongated contact strip 76 formed into a circular configuration so as to lie coaxially disposed about and in electrically conductive contact with the outer periphery 67 of the movable bridge member 66.

The switch shown is operated by effecting movement of the movable bridge member 66 to the left as viewed in FIG. 1, causing the contact face 71' on contact button 71 to come into electrically conductive contact with the contact surface 49 of contact button 43. As movement of the bridge member 66 continues to the left, as viewed in FIG. 1, the force applied to move the movable bridge member 66 must overcome the inherent frictional resistance imposed on the contact body 41 by the circular array of resilient contact bars 37 which place the contact body 41 in electrically conductive contact with the bearing member 36 and through the bearing member 36 with terminal member 2. Additionally, the force must be sufficient and must continuously increase to overcome the spring constant of spring 47, and this must be done in such a manner that there is no tendency of the contact surfaces 49 and 71' to bounce apart once contact has been made.

Additionally, the "closing" force exerted on the bridge member must be gradually increased as the current level through these now-mated contact surfaces increases to prevent the natural magnetic forces that are inherent in such a structure from separating the contact surfaces. It has been found that when the structure is designed to provide a non-resonant condition having a "Q" less than unity, all tendency of the contacts to bounce apart is eliminated. This "no bounce" condition is determined by many different factors, including the mass of the movable contact 41, the spring pressure exerted by spring 47, the frictional resistance imposed by the resilient contact bars 37, the mass of the movable bridge member 66 and the velocity of this bridge member at the instant of impact of contact surface 71' with contact surface 49.

To achieve optimum velocity to effect a "no bounce" condition, it has been found that close control of the differential pressure within the envelope on opposite sides of the transverse wall 69 has a great deal of significance. To admit a fluid medium into the interior of the envelope to impose a driving force on the movable bridge member 66, the terminal members 2 and 51 are provided with ports 78 and 79, respectively.

Port 78 is connected by appropriate passageways 81 and 81' which communicate with the interior of the envelope. Port 79 in terminal member 51 is connected by passageway 82 and an axially extending bore 83 the terminal end of which communicates with a shallow annular groove 84 which in turn communicates through a shallow recess 86 formed in end plate 62 to deliver fluid under pressure into the interior of the bore 56 behind, or to the right as viewed in FIG. 1, of the transverse wall 69.

It will be noted that such fluid is prevented from passing through the clearance space between the inner periphery 56 of the terminal member and the outer periphery 67 of the movable bridge member by the "quad" seal ring 73. The result is that continued pressure admitted to the interior of the envelope behind the transverse wall 69 of the movable bridge member causes the piston-like movable bridge member 66 to move to the left at a rate controlled by the differential of pressure admitted behind the piston-like bridge member and the pressure that is admitted to the opposite side of the envelope through the port 78 and passageways 81 and 81' to control pressurization of the envelope on the left side of the transverse wall 69 of the bridge member.

As stated above, it is the differential of these two pressures that controls the velocity of movement of the bridge member 66 between the extreme right non-conductive position illustrated in FIG. 1 and the intermediate position shown in broken lines which corresponds to the position of the contact surface 71' at the instant of contact with the contact surface 49. It will of course be understood that because the pressure differential on opposite sides of the moving bridge member or piston is controlled, the velocity of the bridge member is controlled and therefore the impact force of this member against the movable contact 39 is closely controlled to prevent bounce.

From this intermediate position of operation, it should be understood that because the spring 47 is resiliently pressing the movable contact 39 to the right as viewed in FIG. 1, while the driving force moving the movable bridge member 66 to the left constitutes a gradually increasing force, when the contact surface 71' impinges against the contact surface 49, there will be an interval of no movement of the two parts while the pressure imposed behind the piston-like bridge member 66 builds up to a point sufficient to overcome the spring pressure imposed by spring 47 and several other forces tending to retain the movable contact assembly 39 stationary. During this interval, as illustrated in the graphs, particularly FIG. 18, it will be seen that not only does the pressure behind the bridge member 66 increase, but the contact pressure also increases, as does the current load through the switch.

As illustrated in the graphs, when the pressure behind the bridgeing member 66 is sufficient to overcome the forces tending to keep the movable contact 39 in the position illustrated in FIG. 1, both the movable contact 39 and the movable bridge member 66 will commence moving to the left as viewed in FIG. 1, still maintaining contact between contact faces 49 and 71' and thereby carrying full current load between the terminal members 2 and 51. Continued movement of the assembly to the left results in the skirt portion 68 of the bridge member electrically conductively engaging the circular array of resilient contact bars 24, thus causing an immediate transfer of current carrying capacity to the larger cylindrical electrical conductor constituted by the movable bridge member 66, thus dramatically increasing the amount of current carrying capacity of the switch without attendant losses due to heat. When the space between the terminal members 2 and 51 has been bridged by the bridge member 66, it has been found that the current follows both paths through the switch for most efficient operation.

Once the switch has been changed from the fully "open" configuration illustrated in FIG. 1, to a configuration in which the switch is completely "closed" as illustrated in broken lines, the switch may be maintained continuously in this configuration and will easily carry 25,000 amps of direct or alternating current. What it is desired to "break" or "open" the circuit, the differential pressures on opposite sides of the bridge member are again controlled so as to relieve the pressure on the right hand side of the piston-like bridge member through port 79 while increasing the pressure on the opposite side of the bridge member through port 78, causing the bridge member to move to the right.

As such movement continues, the bridge member disengages itself from the circular array of resilient contact bars 24 but remains in conductive contact with the movable contact 39 by virtue of the continued engagement of contact surfaces 49 and 71'. Such continued engagement between the bridge member and the movable contact 39 is assured by the biasing effect of the spring 47, and by controlling the differential pressure on opposite sides of the transverse wall 69 of the movable bridge member. When the movement of the bridge member has reached the intermediate position illustrated in broken lines in FIG. 1, continued movement of the bridge member and contact button 71 to the right beyond this point effects separation of the contact surfaces 49 and 71' and interruption of the current flowing through the switch in a pressurized atmosphere created by the fluid pressure giving impetus to the movable bridge member.

Figure 17:
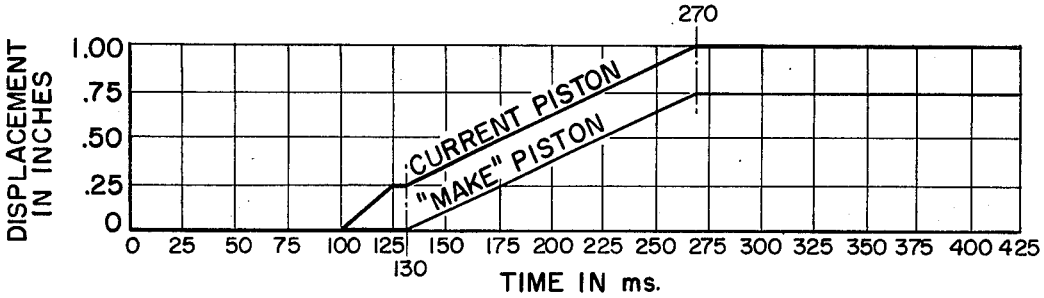
FIG. 17 is a graph illustrating a trace in which displacement in inches of the "make" piston and the bridge piston or bridge member is plotted against time in milliseconds.
Figure 22:
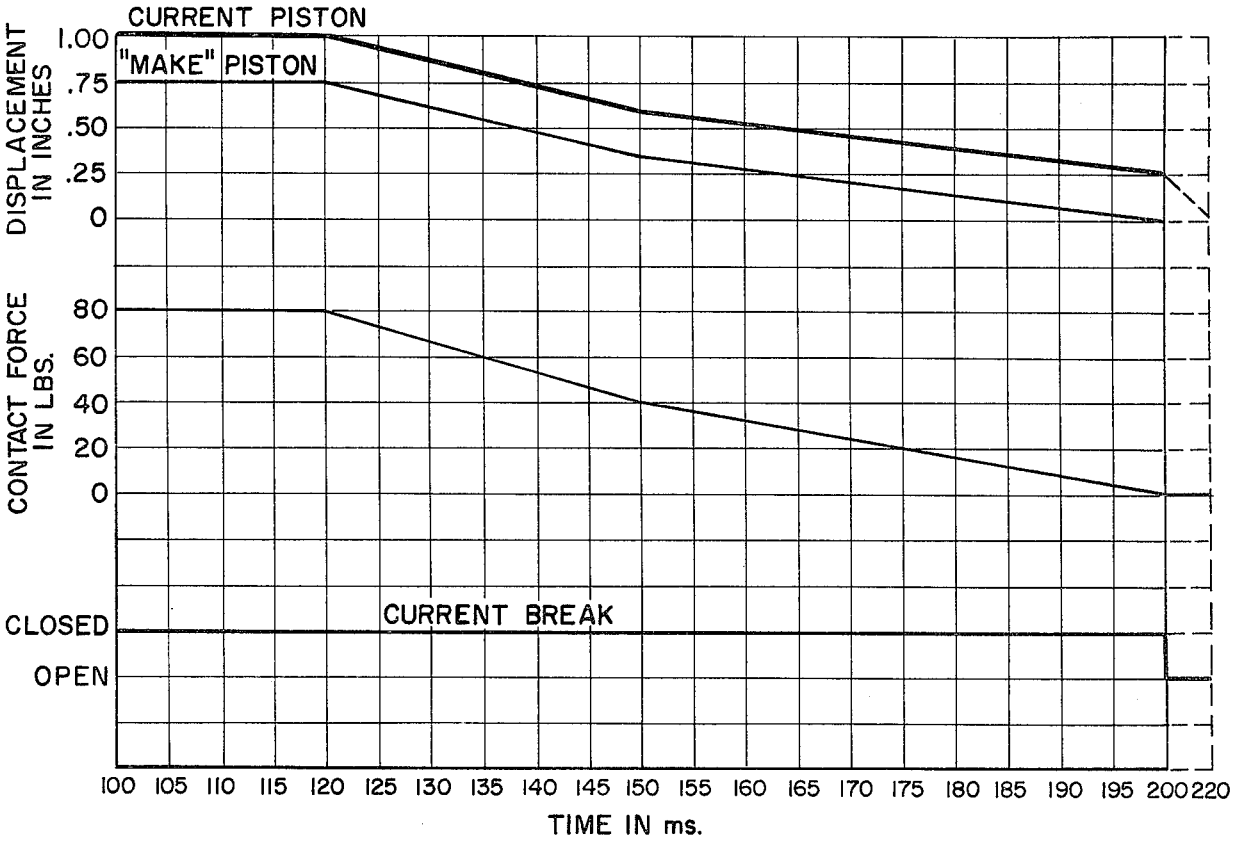
FIG. 22 is a composite graph similar to FIG. 18 showing traces of piston travel, contact pressure in pounds and current "break" plotted against time in milliseconds when the switch is operated in a "break" mode.

It has been found that when the switch is operated in a "make" mode, as illustrated graphically in FIG. 17, the entire operation is completed within about 275 milliseconds and results in the full load of 25,000 amps or more being effectively imposed and carried on the switch structure. On the other hand, when the switch is operated in the "break" mode as illustrated in FIG. 22, the complete operation is accomplished in approximately 200 milliseconds. It has been found that control may be accomplished with a standard 4-way air valve. Since the switch is controlled by pressure differential, air pressure is not critical, and the velocity of the bridge member is constant throughout a wide range of source pressures, i.e. 20 to 80 P.S.I.G., provided the same pressure differential is maintained.

Figure 24:
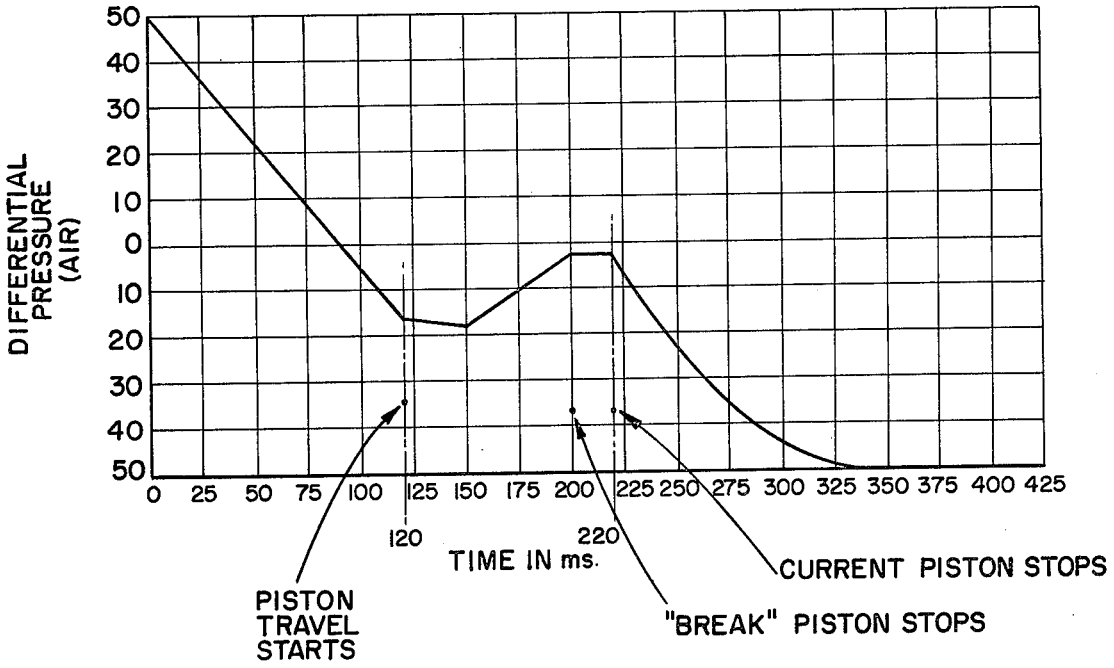
FIG. 24 is a graph similar to FIG. 20 illustrating differential pressure on opposite sides of the current piston or bridge member plotted against time when the switch is in a "break" mode.

Before explaining in detail the significance of the graphs illustrated in FIG. 17, through 24, it is believed expedient to explain the invention as illustrated in FIGS. 6, 7 and 8. Referring to FIG. 6, the switch structure there shown operates essentially on the same principle as the switch structure illustrated in FIG. 1 and differs from FIG. 1 in details of geometry. Operating models of these two switch structures have indicated that the current carrying capacity of the geometry illustrated in FIG. 1 is somewhat less than the current carrying capacity of the structural geometry of the switch as illustrated in FIG. 6. Accordingly, it may be stated that the geometry illustrated in FIG. 6 is the preferred geometry to achieve high levels of "make", "break", and current carrying capacity of both direct and alternating current.

The structure depicted in FIG. 6 is approximately full size, six inches in length along the longitudinal axis 101 and eight inches in diameter, the switch as a whole, and its components, being generally symmetrical about the longitudinal axis. The switch takes the form of an enclosed housing designated generally by the numeral 102, and includes terminal members 103 and 104 spaced axially one from the other along the longitudinal axis 101, and held in axially spaced and electrical isolation by a dielectric sleeve 106, one end 107 of which is sealingly engaged to the terminal member 103, while the other end 108 is sealingly engaged to the terminal member 104 as shown. A suitable epoxy cement may be utilized to permanently and sealingly secure the cylindrical dielectric member 106 to the associated terminal member 103 and 104. The resulting structure is symmetrical about the longitudinal axis 101 and is rigid and rugged in its construction.

The terminal 103 is annular in its configuration, having an inner peripheral bore 109 formed with a pair of undercut keylock grooves 112 and 113 for purposes which will hereinafter be explained. Terminal 103 is provided with an outer face 114 which has formed therein a plurality of bores 116 forming a bolt circle for attachment of appropriate terminal leads to the switch. There are preferably twelve such bores circumferentially evenly spaced about the axis of each end of the switch. The interior face 117 of the terminal 103 is provided with an annular groove or channel 118, the bottom of the channel being formed with an additional annular channel or recess 119 formed by an outer peripheral wall 121, an inner peripheral wall 122 and a bottom surface 123 as shown. The annular channel 119 is coaxially positioned with respect to the central axis 101, and coaxially related with respect to the inner periphery 109 of terminal member 103. Additionally, the channel 119 is spaced radially outwardly from the central axis 101 to a position substantially midway between the inner periphery 109 of the terminal member and the dielectric sleeve 106. Stated another way, the channel 119 is generally centrally disposed within the annular groove 118.

Figure 13:
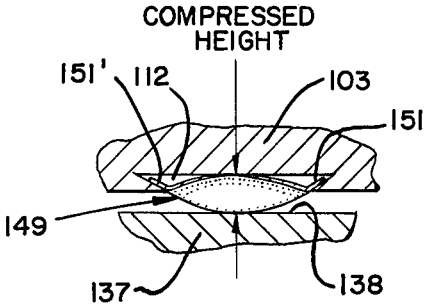
FIG. 13 is an enlarged fragmentary sectional view showing the contact strip of FIGS. 10 and 11 trapped in a keystone slot.

As indicated in the drawing the transition from annular channel 118 to annular channel 119 is relieved by chamfering the corners as illustrated. Additionally, the outer wall 121 of channel 119 is provided circumferentially with an undercut keylock groove 124, while the inner peripheral wall 122 of the channel 119 is also provided with an undercut keylock groove 126 as shown. By "keylock" groove is meant a groove in which the side walls of the groove are undercut or inclined inwardly so that the bottom of the groove is wider than the opening thereinto. This construction is illustrated in FIGS. 13 and 14. It should be noted tht the annular grooves 112 and 113 formed in the inner periphery 109 of the terminal member are also of the keylock type.

The inner peripheral bore 109 of the terminal member 103 adjacent the end face 114 thereof is provided with an enlarged diameter portion 127 within which there is seated a Teflon bearing member 128 as shown. Additionally, a recess 129 is formed in the end face 114 of the terminal member to form a seat, and the seat is adapted to support an end plate 131 secured to the associated terminal member by means of suitable cap screws 132. The end plate 131 seals the central or inner peripheral bore of the terminal member by means of appropriate "O" rings 133. It should be noted that the bearing member 128 is longer than the bore 127 into which it is fitted, and thereby projects into recess 129. To accomodate the end of the cylindrical bearing member 128, the end plate 131 is provided with an annular recess 134 as shown. It has been found that this construction is helpful in removing the bearing member for inspection or replacement.

Slideably disposed within the central bore 109 of the terminal member 103 is a movable contact assembly designated generally by the numeral 136. This movable contact assembly is generally cylindrical in its configuration, having a cylindrical wall 137 the outer periphery 138 of which constitutes an electrically conductive contact surface in a manner which will hereinafter be explained. At its end adjacent end plate 131, the cylindrical wall 137 of the movable contact assembly is provided with a radially outwardly extending flange 139 the outer periphery 141 of which is adapted to slideably bear against the inner periphery 142 of bearing member 128, which is preferably fabricated from "Teflon", a flurocarbon synthetic resinous material possessing desirable self-lubricating qualities.

Adjacent its other end, the cylindrical movable contact assembly 136 is provided with a transverse wall 143 integral with the cylindrical wall 137 and disposed between the cylindrical wall 137 and a continuation of that wall in the form of cylindrical extension 144. Within the recess 146 formed by the intermediate wall 143 and the cylindrical extension 144, there is appropriately mounted a base plate 147, cylindrical in its configuration and centrally recessed to receive a contact button 148.

For purposes of desirable electrically conductive characteristics, the terminal member 103 is fabricated from high conductivity aluminum, preferably a 6,000 series aluminum, while the movable contact sleeve 137 is preferably fabricated from copper. The base plate 147 is also preferably fabricated from copper and is silver brazed at a high temperature, in the order of about 900° C., to the contact button 148. This subassembly is subsequently soft silver solder brazed to the intermediate wall 143, the temperature of this braze being in the order of 350° C..

To effect a desirable electrical conductivity between the slidably disposed movable contact assembly 136 and the surrounding terminal member 103, the keylock grooves 112 and 113 are provided with and lockingly receive elongated strip contacts 149 and 149' preformed to provide a multiplicity of substantially parallel axially extending resilient contact bars 150 similar to resilient contact bars 24 illustrated in FIG. 3. When the contact strips are inserted into the grooves 112 and 113, each provides edge contact between each of the resilient contact bars and the inner peripheral surface (bottom) of each of the associated grooves, while the opposite edge of each of the resilient contact bars resiliently and electrically conductively impinges upon the outer periphery 138 of the movable contact assembly 136.

Thus, the parallel and axially spaced contact strips 149 and 149', arranged in a pair of circular arrays to conform to the configuration of the grooves 112 and 113, present axially extending but transversally resilient contact bars 150 which are circumferentially spaced in a circular array about the movable contact 136 to provide optimum electrical conduction between the movable contact assembly and the surrounding terminal member 103. In addition to providing electrical conductivity, the resilient contact bars provide stability in the structure, preventing the movable contact from chattering, i.e., being displaced laterally within the bore, and additionally impose a frictional resistance between the terminal member 103 and the movable contact 136 which is important in controlling the operation of the switch to provide a "no bounce" characteristic. The manner in which this is achieved has been discussed in connection with FIG. 1, but will be discussed in greater detail hereinafter.

At this point it is well to note that the construction of the contact strip 23 as illustrated in FIG. 5, differs somewhat from the construction of the contact strips 149 and 149' as used in FIG. 6. The FIG. 5 contact strip is provided with laterally projecting tabs 22 which cooperate with split spring rings 28 and 29 to retain the contact strip locked in the groove. The contact strips 149 do not have laterally projecting tabs, and split spring rings are therefore not needed to retain the contact strips in the groove. Instead, as shown in FIGS. 10–13, each contact strip 149 is provided with marginal edge portions 151 and 151' that are angularly disposed with respect to the transverse dimension of the contact strip. The bend preferably is located at or near the root 152 of each of the resilient contact bars where it is integrally joined with the associated edge portion 151 or 151'.

Figure 10:
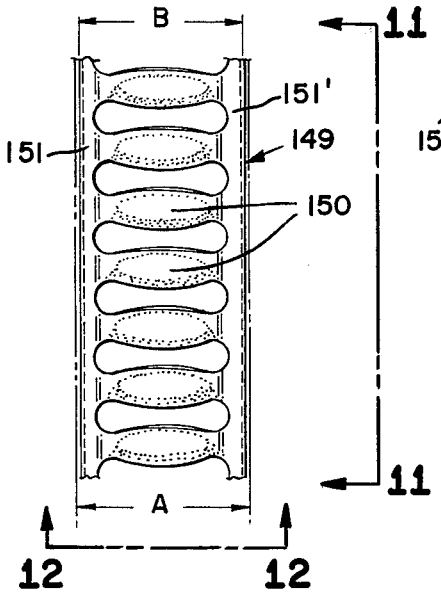
FIG. 10 is a plan view of a novel electrically conductive contact-forming strip constructed in such a way as to ensure high current carrying capabilities.
Figure 11:
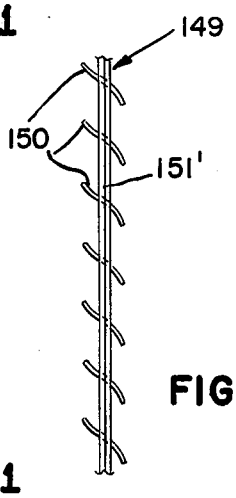
FIG. 11 is an edge view of the electrically conductive strip of FIG. 10.
Figure 12:
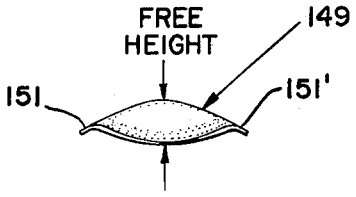
FIG. 12 is an end view of the strip of FIGS. 10 and 11.

Referring to FIGS. 10–13, the contact strip 149 is preferably formed from a material having high electrical conductivity, such as berryllium copper, and starts out as a flat elongated strip having a width A and an indeterminate length. The strip is fed into an appropriate forming die which punches out successive portions, leaving the spaced contact bars 150 extending transversally across the strip as shown in FIG. 10. Either simultaneously, or in separate forming steps, the transversally extending bars 150 are shaped and twisted out of the plane of the flat strip as shown in FIG. 11, and the edge portions 151 and 151' are also bent downwardly out of the plane of the flat strip as shown in FIG. 12.

This results in opposite arcuate edge portions of each transversally extending resilient contact bar projecting on opposite sides of the plane of the flat strip. As viewed in FIG. 13, the angularity of the longitudinal edge portions closely corresponds to the angle of the undercut keystone or keylock groove. Thus, the specially formed contact strip, preferably silver plated to enhance its electrical conductivity, may be slipped into the keylock groove as shown in FIG. 13 so that one arcuate edge portion of each resilient contact bar electrically conductively impinges resiliently against the inner peripheral surface or bottom of the associated keylock groove 112. The opposite arcuate edge of each resilient contact bar projects beyond the limits of inner and outer wall surfaces 122 and 121 respectively of annular channel 119 and beyond the inner periphery 109 of terminal 103. These latter arcuate edges are thus in a position to resiliently and electrically conductively impinge against associated structure, such as the outer cylindrical periphery of movable contact assembly 136, and other structure as will hereinafter be explained. In so impinging, each angularly twisted resilient contact bar 150 is compressed by a rotary moment of force applied to opposite arcuate edges by the surfaces against which the arcuate edges impinge. This tends to compress or untwist the resilient contact bar by reducing its compressed height (CH) as shown in FIG. 13, thus resiliently loading or stressing the contact bar so that it tends to regain its initial free height (FH) as shown in FIG. 12.

Referring now to FIG. 6, and specifically to the movable contact assembly 136, and the chamber 152 formed between the cylindrical wall 137 of the movable contact assembly 136 and the intermediate wall 143, there is interposed a coil compression spring 153. One end reacts against end plate 131 as shown, while the opposite end reacts against the intermediate wall 143. Spring 153 imposes a constant biasing force against the movable contact assembly 136, urging it to the right as viewed in FIG. 6, so that ultimately it achieves a full right position as illustrated in FIG. 8. In this full right position the radially extending flange 139 comes into abutment with the inner end of bore 127. This limits movement of the movable contact 136 to the right and as seen in FIG. 8, places the contact surface 154 of contact button 148 in a substantially median plane between the ends of the switch structure. To eliminate "bounce" in the switch when operated in a "closing" mode, the mass of the movable contact 136, the frictional resistance imposed by the resilient contact bars 150 and the characteristics of spring 153 are calculated in a manner and for reasons which will hereinafter be clear.

Also formed in the terminal member 103 is a port 156 communicating with a radially extending passageway 157 which in turn communicates with axially extending passageways 158 and 159 as shown. The passages 158 and 159 communicate at their ends remote from passageway 157 with the interior of chamber 161 for a purpose which will hereinafter be explained.

At the opposite end of the switch structure, the terminal member 104 is also annular in its configuration, having an inner periphery 162 and including an electrically conductive annular support portion 163 the inner face 164 of which is parallel to and axially spaced from the outer face 166 of the terminal member. As illustrated in FIG. 6, the face 164 of the axially inwardly projecting support portion 163 lies in a plane substantially coincident with face 117 of terminal member 103. However, because of the channel 118, the two inwardly projecting portions of the terminal members 103 and 104 are electrically isolated one from the other in the absence of means for bridging the gap therebetween.

Formed on the inner periphery 162 of the inwardly projecting support portion 163 are a pair of keylock grooves 167 and 168 similar in configuration to the groove 112 in FIG. 13, the two grooves being spaced apart axially as indicated and extending circumferentially around the inner periphery 162 of the terminal member 104. These keylock grooves, as previously explained, receive and retain contact strips 171 and 172, each of the contact strips comprising a multiplicity of interconnected electrically conductive resilient contact bars 173 which when arranged in a circular array by being seated in the circular grooves 167 and 168, provide a multiplicity of circumferentially spaced parallel edge portions resiliently impinging against the bottom of the grooves 167 and 168 to thereby place the resilient contact bars in intimate electrically conductive contact with the terminal member 104.

At its end opposite the inwardly projecting support portion 163, the bore 162 of terminal member 104 is provided with a rabbet 174. To sealingly close the bore 162 there is provided an end plate 176 suitably seated on the shoulder formed by rabbet 174 and secured to the terminal member by a multiplicity of cap screws 177 sealingly compressing a suitable "0" ring seal 178. The end plate 176 is provided with a shoulder 179 that aids in properly positioning the end plate on the terminal member, and formed on the end plate inside the shoulder 179 is a rabbet 181 formed to provide an annular space 182 between the end plate and the inner periphery 162 of the terminal member to give access to the interior of the envelope, particularly chamber 183 thereof, through an appropriate passageway 184 communicating with port 186 formed on the periphery of terminal member 104 as shown.

The end plate 176 is itself annular, having a central bore 187 and an inwardly projecting cylindrical flange 188. The inner peripheral bore 187 of the end plate and flange supports a "quad" seal ring 189 at its inner end, a cylindrical sleeve 191, preferably fabricated from teflon or some other suitable synthetic resinous material, and a snap ring 192 suitably seated in a groove formed in the end plate to lock the dielectric sleeve in position. It will thus be seen that the inner peripheral surface 193 of the teflon sleeve 191 possesses a smooth cylindrical bore to provide a stabilizing support bearing for structure which will now be explained.

Sideably displaced within the envelope and having elements projecting into chambers 161 and 183, is a pistonlike member designated generally by the numeral 201 and constituting a highly electrically conductive bridge member adapted to be controllably moved axially within the envelope to effect actuation of the switch. The bridge member comprises a generally H-shaped unit including cylindrical wall portions 202 and 203 joined integrally by transverse wall portion 204, and effectively isolating chamber 161 of the envelope on the left of the transverse wall 204 as viewed in FIG. 6 from the chamber 183 to the right of the transverse intermediate wall. The intermediate wall 204 is itself electrically conductive and is provided within chamber 161 with a support surface 206, and within chamber 183 with a support surface 207.

As indicated in the drawing, the intermediate wall 204 is positioned intermediate the ends 208 and 209 of the bridge member. Coaxially arranged on the support surface 206 within envelope chamber 161 is a base support plate 212 which in turn has mounted thereon a contact button 213. The contact button 213, is silver brazed at a relatively high temperature, in the order of 900° C., to the contact base support plate 212, which latter member is soft silver soldered to the surface 206 of the intermediate wall 204 at a temperature in the order of 350° C. The contact button 213 is provided with a contact face 214 coaxially arranged with respect to the contact button 148 and adapted to electrically conductively engage the contact face 153 of the contact button 148. Stated another way, the contact faces 214 and 154 lie parallel to each other, coaxially arranged with respect to the central axis 101, and are movable relative to each other in a manner which will hereinafter be explained to bring the two contact surfaces together in a "make" operation and to separate these surfaces in a "break" mode of operation of the switch. It should be noted that as compare to the relatively rough surface engagement of contacts in conventional switches as illustrated in FIG. 15, the contact surfaces 214 and 154 of this invention intimately engage over a much broader area, thus increasing the current carrying capacity of the switch.

On the opposite side of the intermediate support wall 204 there is mounted a generally T-shaped member designated generally by the numeral 216, and including a cylindrical stem 217 the outer periphery of which is adapted to slidably engage the inner periphery 193 of the teflon sleeve 191 as shown. Additionally, the outer periphery of the cylindrical stem 217 of the T-shape member sealingly engages the inner periphery of the "quard" seal ring 189, thus preventing the passage of fluid (air or liquid) between the inner periphery of the end plate 176 and the outer periphery of the cylindrical stem 217. The inner end of the stem is provided with a radially extending cylindrical flange 218 suitable secured to intermediate support wall 204 by appropriate cap screws 219. At its opposite end the stem 217 of the T-shape member is provided with a central bore 221 threaded interiorly to receive a number of different selected indicator means (not shown) that may be mounted on the stem and which extend outside tne envelope to indicate the position of the bridge member 201 within the envelope.

The bridge member functions to span the space between the terminal members 103 and 104 and to thereby eliminate the electrical isolation therebetween provided by the space between their inner ends and the isolation provided by the dielectric sleeve 106. To effectively accomplish this purpose, the outer periphery 222 of the bridge member is porportioned to slip into the interior bore 162 of the terminal member 104 and to engage the multiplicity of resilient contact bars forming integral portions of contact strips 171 and 172. Thus, the resilient contact bars are resiliently stressed so that they impinge on the one hand against the bottom of the grooves 167 and 168 and on the other hand against the outer peripheral surface 222 of the bridge member 201. In so impinging against the movable bridge member 201, the resilient contact bars impose a predetermined amount of frictional resistance so as to stabilize movement of the bridge member. Additionally, the cylindrical portion 203 of the bridge member is provided with an appropriate "quad" ring seal 223 suitably seated in an appropriate annular groove formed about the outer periphery of the cylindrical portion 203 of the bridge member so that the outer periphery of the "quard" ring sealingly slidably engages the inner peripheral surface 162 of the terminal member.

At the opposite end of the bridge member, the cylindrical portion 202 is proportioned in thickness to provide an inner periphery 224 which with the outer periphery 222 slips snugly into the annular channel 121 formed in the terminal member 103 and in so passing into the channel 121, comes into intimate mechanical and electrically conductive contact with the circular array of resilient contact bars seated and supported in the annular grooves 124 and 126 so that the axially extending resilient contact bars electrically conductively engage the bottoms of the grooves in which they are retained and resiliently impinge electrically conductively against the outer peripheral surface 222 of the bridge member and the inner peripheral surface 224 of the cylindrical portion 202 of the bridge member.

As stated previously, the frictional resistance imposed by these resilient contact bars on the movable bridge member surfaces is important for at least two reasons. First, the resilience of the contact bars ensures excellent electrical conduction between the movable bridge member 201 and the associated terminal members 103 and 104. Secondly, the frictional resistance caused by the resilient impingement of the bars on the movable bridge member imposes a resistance to movement or damping effect that is important in controlling the movement of the movable bridge member 201.

Since for these two reasons it is important that the inherent resilience of the resilient contact bars be maintained, it is also important that through repeated operations of the switch that the resilient contact bars be permitted to relax momentarily from their stressed position. To accomplish this, with respect to the contact strips enclosed within grooves 167 and 168, there is provided an annular groove 226 in the outer periphery 222 of the movable bridge member which, as it passes a zone encompassed by the resilient contact bars, permits the resilient contact bars to flex and expand into the groove before they are again compressed or flexed resiliently by continued movement of the bridge member and encroachment against the resilient contact bars of the outer periphery 222 of the bridge member.

It will thus be seen that through effective control of the mass of the movable bridge member 201, the resistance to movement imposed by the resilient contact bars on the moveable bridge member, the resistance to movement imposed on the movable contact member 136 by the contact strips 112 and 113, and the effect of spring 153, a differential pressure may be established within chambers 161 and 183 that controls movement of the movable bridge member 201 in either direction to effect either a "make" operation of the switch or a "break" operation of the switch. As explained in connection with the operation of FIG. 1, proper control of the differential pressure in the chambers 161 and 183 results in movement of the bridge member to the right (as viewed in FIG. 6) in a "break" mode of operation, movement continuing until the end portion 202 of the movable bridge disengages itself from the associated resilient contact members and thereby interrupts the flow of current through the movable bridge member into the terminal 103.

During this interval, the contact faces 154 and 214 are of course engaged and conducting current therethrough. Obviously, when the moveable bridge member 201 disengages it self from terminal member 103, the current level through the moveable contact 136 increases during a short interval during which the moveable contact member 136 reaches the limit of its movement to the right into the position illustrated in FIG. 7, from which point continued movement of the bridge member 201 to the right effects a separation of the contact faces 154 and 214 to thus effect a total interruption of current flow through the switch. The separation is effected in point of time prior to the current level reaching a peak through the moveable contact 136, and it has been found that upon separation of these contact buttons 148 and 213, there is virtually no arcing between the faces 154 and 214. Continued movement of the bridge member 201 to the right results in achieving the position thereof illustrated in FIG. 8 in which the switch is fully in a "break" mode.

Referring now to FIG. 8, which shows the switch structure in a completely "open" or "break" condition, and FIGS. 17 through 20 which illustrate various parameters measured against time when the switch structure of FIG. 8 is operated in a "make" mode of operation, it will be noted that it takes just under 100 milliseconds to increase the pressure within the envelope to achieve preferred balance of pressure within the envelope. It has been found that with the configuration illustrated in FIG. 8, the pressure will rise at about 12 lbs. per millisecond, the pressure in chamber 183 on the right side of the bridge member 201 increasing at that rate, while the pressure on the opposite side of the bridge member 201 in chamber 161 diminishes to the point where the pressure on opposite sides of the bridge member will equalize at a pressure of approximately 25 lbs. per square inch, at which point the movable bridge member is in a static condition.

From this point, which is reached in about ninety milliseconds (FIG. 19), pressure in chamber 183 increases and pressure in chamber 161 decreases until, after approximately 100 milliseconds from the commencement of the "make" operation, the moveable bridge member 201 moves to the left as viewed in FIG. 8 at a substantially constant rate. The pressure on opposite sides of the piston is controlled so as to provide a substantially constant rate of movement and a substantially constant differential pressure on opposite sides of the moveable bridge member for approximately 25 milliseconds. During this latter interval, the movable contact button 213 is moving to the left at a constant rate with the movable bridge member 201 (FIG. 18), and after approximately 125 milliseconds from the commencement of the "make" operation, the contact faces 154 and 214 come into contact one with the other and "make" the circuit through the movable contact assembly 136.

Figure 18:
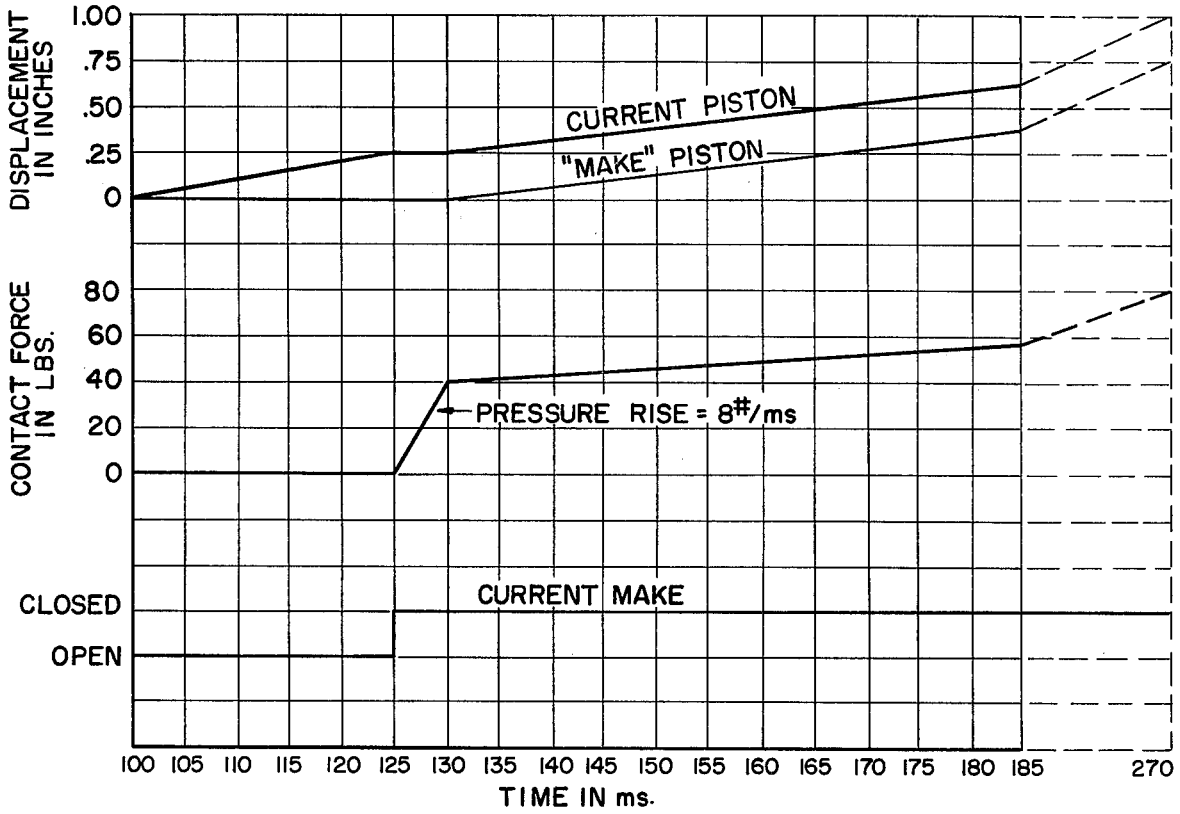
FIG. 18 is a graph similar to FIG. 17 but expanded in scale in which the abscissa values start at 100 milliseconds, and plotting piston travel, contact pressure in pounds, and current "make" with time in milliseconds.
Figure 19:
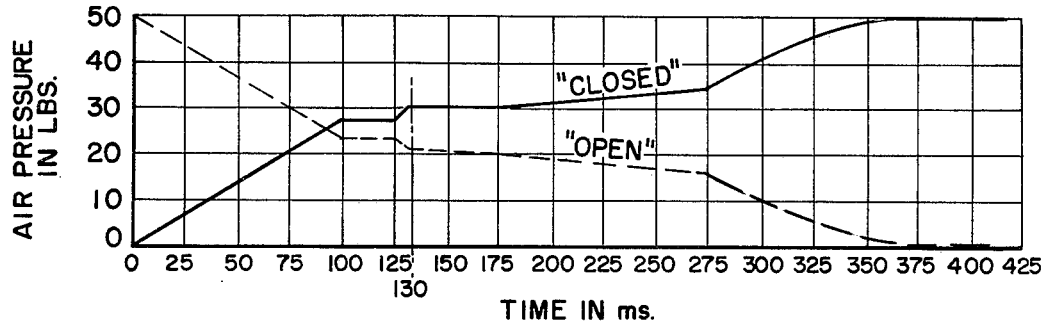
FIG. 19 is a graph illustrating the relationship between air pressure in pounds plotted against time in milliseconds on the "closed" and "open" side of the bridge member or piston.
Figure 20:
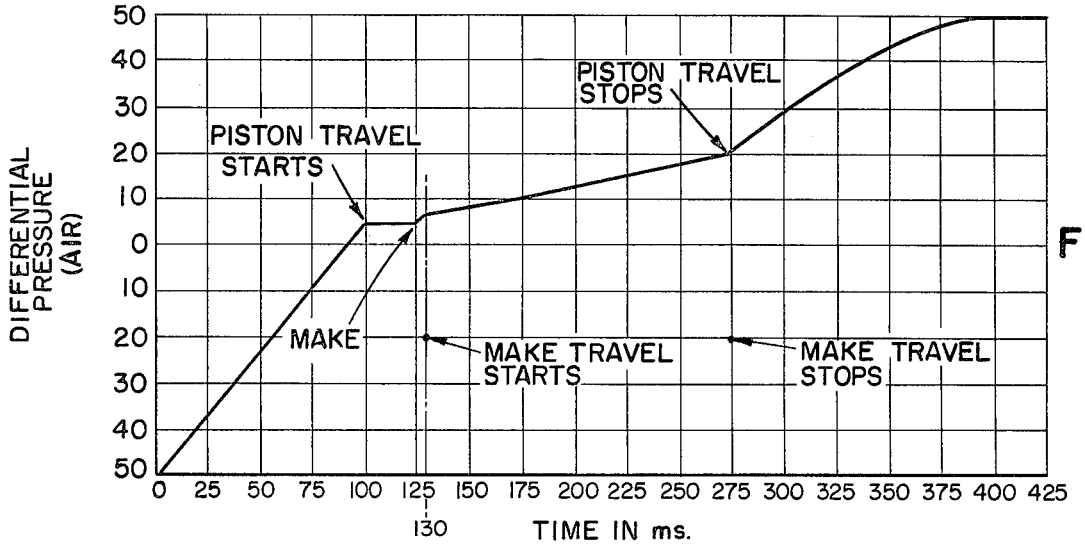
FIG. 20 is a graph illustrating differential pressure in pounds applied to the bridge member or piston and plotted against time in milliseconds.
Figure 21:
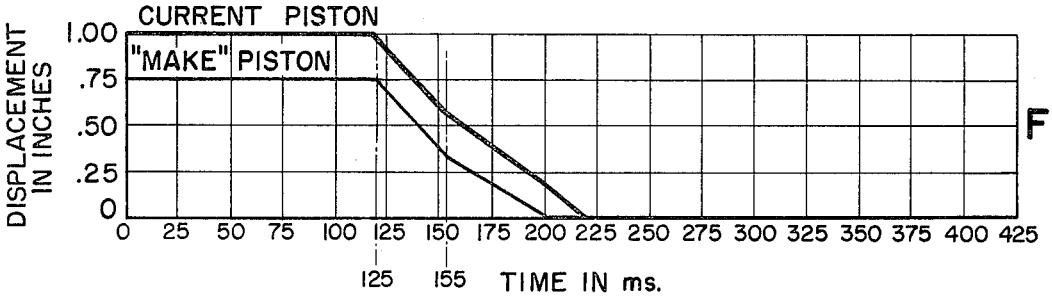
FIG. 21 is a view similar to FIG. 17 illustrating displacement of the "make" piston versus the current piston or bridge member plotted against time when the switch is in a "break" mode.

At this point, as illustrated in FIGS. 19 and 20, the movable and now engaged contact buttons 148 and 213 remain stationary for approximately 5 milliseconds during which time the pressure within chamber 183 builds up to a point sufficient to increase the differential pressure and overcome the frictional forces imposed by the contact strips 112 and 113, and the spring pressure exerted by spring 153. When the differential pressure between chamber 183 and 161 is increased the appropriate amount, this being approximately 8 lbs. per square inch differential, the movable bridge member 201 and the movable contact assembly 136 again commence movement to the left. Differential pressure is continually and controllably increased to maintain a linear relationship between the pressure in chamber 183 and the current level flowing through the movable contact assembly 136 which is of course increasing (FIG. 18).

It should be noted that as the movable assemblies move to the left from their positions as viewing in FIG. 7, the spring pressure exerted by spring 153 increases with travel, thus requiring less fluid pressure in chamber 161, which is replaced by the spring pressure, but simultaniously requiring a continued increased in fluid pressure in chamber 183 to maintain appropriate contact pressure between contact faces 154 and 214 in relation to the current being carried. This reduction of pressure in chamber 161 with coincident increase in pressure in chamber 183 is illustrated graphically in FIG. 19. As there shown, after about 270–275 milliseconds from the commencement of the "make" operation, both the bridge member 201 and the movable contact assembly 136 have reached their ultimate "make" positions at which full current may be carried through the switch.

The pressure in chamber 183 is increased from approximately 35 psi. to 50 psi. on the "close" side of the movable member 201 (chamber 183) in order to latch the assembly in a "closed" configuration. Conversally, in chamber 161, spring 153 has reached its calibrated maximum pressure point, thus maintaining the desired pressure between contact faces 154 and 214, and of course acting in opposition to the fluid pressure maintained at 50 lbs. psi. in chamber 183. Thus, FIGS. 17 through 20 illustrate graphically the mechanical movements of the movable bridge 201 and the movable contact assembly 136 in terms of displacement in inches, contact force in pounds between contact buttons 148 and 213, and differential pressure within the envelope to effect a transition of the switch from a fully "open" position (FIG. 8) to a fully "closed" position as illustrated in FIG. 6.

In terms of what is happening current-wise, reference is made to FIGS. 17 and 18, FIG. 17 being a composite graphic view that measures displacement of the movable contact assembly 136 and the movable bridge member 201 against time in milliseconds starting from 0. FIG. 18 is an expanded view of the parameters illustrated in a composite way in FIG. 17, but carrying the time forward to 100 milliseconds after inception of action to change the condition of the switch. Referring first to FIG. 17, it will be seen that during the first 100 milliseconds, as previously discussed in connection with FIGS. 19 and 20, pressure is building up within the switch and no movement is occurring of the movable bridge member.

After about 100 milliseconds, continued buildup of pressure starts movement of the movable piston-like bridge member 201 for approximately 25 milliseconds and for a displacement of approximately 0.25 inches. At this point in time contact is made between the movable contact faces 154 and 214 and further displacement ceases for a time as illustrated by the horizontal portions of the curve between 125 milliseconds and approximately 130 milliseconds, at which point in time continued buildup of pressure and generation of a pressure differential on opposite sides of the movable piston bridge 201 causes both the movable bridge 201 and the "make" assembly 136 to move simultaneously until approximately 270–275 milliseconds after commencement both the movable bridge member 201 and the movable contact assembly 136 are fully seated and displacement of both movable members terminates. It is noted that after both the "make" assembly 136 and the bridge member 201 start to move again, the bridge member 201 does not engage the complimentary contact strips 124 on the opposite terminal until approximately 270 milliseconds after commencement of the action. This is indicated in FIG. 17.

Referring to FIG. 18, which, as explained above, is an expanded version of the graph of FIG. 17 comparing piston displacement with contact force in lbs. and illustrating the current "make" point in time, it will be seen that as before, the contact faces 154 and 214 come into current carrying abutment after approximately 125 milliseconds and a displacement of about 0.25 inches. From this point in time (125 ms.) contact force rises without oscillation from zero to approximately 40 lbs. in the next five milliseconds, the force rate of rise being approximately 8 lbs. per millisecond.

When 130 milliseconds of time have elapsed, movement of the movable bridge member 201 and the movable contact assembly 136 resumes, and as seen by comparing the first and second curves in the graph illustrated in FIG. 18, the pressure from the point in time of continued movement of the assembly (130 ms.) continues to rise steadily and without oscillation until approximately 185 milliseconds have elapsed and the contact force has reached approximately 55 lbs.

It should be noted that during the course of this movement, the movable bridge member 201 comes into electrically conductive engagement with the opposite terminal member so as to provide a second current path through the switch, relieving the current load on the movable contact assembly 136 and assuming the major current load through the switch. It is believed that from the foregoing anyone skilled in the art will be fully instructed not only in the construction of the switch but also in its mode of operation to achieve a 25,000 amp current carrying load.

FIGS. 21 through 24 illustrate in graphical form the movement of the movable bridge member 201 and the associated movable contact assembly 136 when the switch is operated in a "break" mode, commencement of operation in the "break" mode starting with the switch in the condition illustrated in FIG. 6. It is significant to note that in connection with operation of the switch in a "make" mode as previously discussed, the movable current carrying piston-like bridge member 201 and the associated movable contact assembly 136 move at a velocity of approximately 6 inches per second. On the other hand, when the switch is operated in a "break" mode as illustrated in FIGS. 21 through 24, the velocity of the movable members is increased to approximately 10 inches per second. It should be understood that the velocity of the movable bridge member 201 in either direction is closely controlled by appropriate pressure differentials within the envelope.

Figure 23:
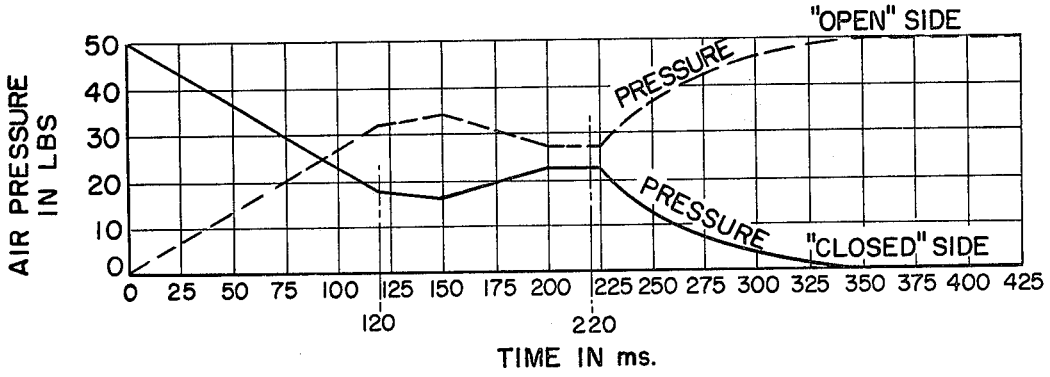
FIG. 23 is a graph illustrating air pressure in pounds against time in milliseconds when the switch is in a "break" mode.

Referring to FIG. 23, it will be seen that from the position of the switch as viewed in FIG. 6, air pressure in chamber 183 is decreased linearly in point of time for approximately 100 milliseconds while simultaneously, pressure in chamber 161 is increased linearly from 0 lbs. until the traces cross at approximately 25 lbs. At this point the pressure differential on opposite sides of the movable bridge member 201 is essentially zero and movement has not yet commenced. From this point however increased pressure in chamber 161 to effect "opening" movement of the switch and decreased pressure in chamber 183 for approximately 20 milliseconds in order to provide a pressure differential of approximately 12 lbs. within the envelope causes the movable bridge member 201 to start moving to the right as viewed in FIG. 6 to effect "opening" action of the switch.

It should be noted at this point that both the bridge member 201 and movable contact assembly 136 are moving to the right in unison, contact pressure being maintained on contact surfaces 154 and 214. It should be seen from the graphs in FIGS. 23 and 24 that at 150 milliseconds the differential pressure is maximum and that from this point in time the differential pressure diminishes until at 200 milliseconds after commencement of the "breaking" action, the differential pressure is only approximately 5 lbs. between opposite sides of the movable bridge member 201. Additionally, at 200 milliseconds the contact faces 154 and 214 separate by virtue of the movable contact assembly 136 reaching its extreme right hand position of travel. At this point the movable bridge member 201 has already separated and is therefore not conducting, the circuit through the switch is broken and the differential pressure increases in chamber 161 to maintain the switch in "open" position, while the pressure in chamber 183 drops to zero so that the switch will remain latched in "open" condition.

From the foregoing it will be apparent that operation of the switch in the mode illustrated and described is effective to control movement of the movable bridge member 201 and the movable contact assembly 136 that initially "makes" and "breaks" a circuit through the switch, and that by controlling the velocity of actuation of the switch, current levels up to 25,000 amps of direct and alternating current may be handled by the switch structure. To say the least, the current carrying capacity of the switch illustrated and described is unusual. One of the parameters believed to be a contributing factor to this current carrying capability is the fact that the contact buttons 148 and 213 are fabricated from a refractory material—silver tungsten. Upon closing in on high current, the initial engagement between contact faces 154 and 214 is believed to be as depicted in FIG.

15 where the roughness of the contact faces, even though polished, results in a multiplicity of essentially "point" contacts being formed, presenting "points" of high electrical resistance with consequent localized heating in the area of contact, resulting in an almost instantaneous melting of the silver at both contact faces 154 and 214. The resulting "melt" of the silver fraction of the opposed surfaces appears to "spread" across the contact faces 154 and 214 to provide a vastly more intimate and extensive area of engagement, as illustrated in FIG. 16. The "melt" that is believed to occur, occurs so rapidly that the electrical resistance plunges precipitously, causing an almost instantaneous cessation of the generation of heat that caused the "melt" initially. This rapid reduction in generation of heat appears to "freeze" the melted silver surfaces while intimately engaged, resulting in a large area of the contact faces remaining in intimate current carrying engagement, almost as if there was no line of demarcation between the two contact faces 154 and 214.

Tests conducted with an oscilloscope indicate that the "melt" and "re-freeze" occur in about 30 microseconds. It is surprising that despite the "melt" that occurs between the two now intimately engaged surfaces and the "re-freeze" of those surfaces, there is no tendency for the contact buttons 148 and 213 to "weld" together as with some conventional switch contacts. Contact surfaces examined after hundreds of operations clearly display the effect of "melt" yet, in the operation of the switch, and in disassembly of the switch after hundreds of cycles of operation, there is no evidence of "welding" between the contact faces. The result is that the contact faces remain in large surface high electrical conductivity contact, enabling the handling of current loads not heretofore believed possible in a switch structure of this size.

Having thus described the invention, what is believed to be novel and sought to be claimed and protected by Letters Patent of the United States is as follows:

I claim:

1. An electric switch structure designed to make, break and carry high levels of electrical current in the order of at least 25,000 amperes, comprising:

(a) a pair of axially aligned and spaced electrically conductive cylindrical terminal members each having at least one set of contact bars thereon;

(b) a cylindrical sleeve disposed between said terminal members to retain them in spaced electrical isolation and therewith forming an enclosed envelope;

(c) an electrically conductive bridge member slidably disposed within the envelope and selectively movable in one direction to directly mechanically and electrically connect the terminal members to increase the level of electrical current capable of being carried therebetween and selectively movable in the opposite direction to mechanically and electrically disconnect a portion of the bridge member from one of said terminal members to decrease the capacity for carrying the flow of high level electrical current between said terminal members; and (d) electrically conductive movable contact means disposed within said envelope and responsive to movement of said bridge member to make or break an electric circuit between said terminal members.

2. The combination according to claim 1, in which said contact bars extend parallel to the axis of said terminal members.

3. The combination according to claim 1, in which said sets of contact bars are peripherally arranged on said terminal members.

4. The combination according to claim 1, in which the contact bars of each set are integrally connected and circumferentially spaced.

5. The combination according to claim 1, in which the contact bars of each set are individually resilient.

6. The combination according to claim 1, in which said cylindrical sleeve disposed between the terminal members is fabricated from a dielectric material.

7. The combination according to claim 1, in which said cylindrical sleeve is sealingly disposed between said terminal members.

8. The combination according to claim 1, in which said electrically conductive bridge when connected between said terminal members forms a primary path for electric current therebetween and said movable contact means forms an auxiliary path for the passage of electric current between said terminal members.

9. The combination according to claim 1, in which movement of the bridge member in a direction to connect with the opposite terminal member first effects actuation of the movable contact means to complete a first path for electrical current through the switch and subsequently effects connection of the bridge member directly with the opposite terminal member to complete a second path for electrical current through the switch.

10. The combination according to claim 1, in which said terminal members are annularly symmetrical about a longitudinal axis to provide inner peripheral electrically conductive surfaces, and said sets of contact bars are mounted on the inner peripheries of said terminal members.

11. The combination according to claim 1, in which said terminal members are annularly symmetrical about a longitudinal axis to provide inner peripheral surfaces, said bridge member is cylindrically symmetrical about said longitudinal axis and slidably disposed within the inner periphery of one of said terminal members.

12. The combination according to claim 1, in which said terminal members are annularly symmetrical about a longitudinal axis to provide inner peripheral electrically conductive surfaces, said bridge member is cylindrically symmetrical about said longitudinal axis and slidably disposed sealingly within the inner periphery of one of said terminal members to form a piston dividing the interior of said envelope into first and second pressurizable chambers on opposite sides of said bridge member, and port means on said terminal members communicating with said pressurizable chambers to selectively pressurize said chambers to effect movement of said bridge member in a selected direction.

13. The combination according to claim 1, in which said terminal members are annularly symmetrical about a longitudinal axis to provide inner peripheral electrically conductive surfaces, said bridge member is cylindrically symmetrical about said longitudinal axis and slidably disposed sealingly within the inner periphery of one of said terminal members to form a piston dividing the interior of said envelope into first and second pressurizable chambers on opposite sides of said bridge member, the electrically conductive surfaces of said bridge member, said sets of contact bars and said movable contact means being within one of said pressurizable chambers, and port means on said terminal members communicating with said pressurizable chambers to selectively pressurize said chambers to effect movement of said bridge member in a selected direction to either make or break a circuit through the switch.

14. The combination according to claim 1, in which said bridge member includes an electrically conductive tubular portion coaxially arranged within said envelope and an electrically conductive transverse wall portion integral with the inner periphery of said tubular portion of the bridge member whereby when said bridge member is at one extreme of its movement corresponding to a switch "closed" position one component of electrical current flows axially through the tubular portion of said bridge member spanning the space between said terminal members and then flows radially into the associated terminal member while a second component of electrical current flows radially from said tubular portion through said transverse wall portion, then axially through said movable contact means and then radially into the associated terminal member whereby the magnetic forces generated by said first and second components of current and tending to drive said switch into an "open" position are effectively cancelled.

15. The combination according to claim 1, in which said bridge member and said movable contact means are cooperatively related whereby selected predetermined limited movement of said bridge member in a switch "closed" direction initially completes a first electrically conductive path through the switch that includes one terminal, a radially directed path that includes at least one set of said contact bars and a portion of said bridge member, an axially directed path that includes said movable contact means, and a radially directed path that includes a second set of said contact bars and the other terminal member, and continued movement of said bridge member beyond said predetermined limited movement establishes a second electrically conductive path through the switch that includes one terminal member, the remaining portion of said bridge member and the other terminal member.

16. The combination according to claim 1, in which said bridge member and said movable contact means are cooperatively related whereby selected predetermined limited movement of said bridge member in a switch "closed" direction initially completes a first electrically conductive path between said terminal members through said movable contact means, said electrically conductive path being arranged so that for a first portion of the path the direction of current flow is opposite to the direction of current flow in an adjacent second portion of the conductive path whereby the magnetic force normally generated by current flowing in said first portion of the conductive path and tending to drive the contact means apart is nullified by the magnetic force generated by the current flowing in the opposite direction in said second portion of the conductive path.

17. The combination according to claim 1, in which said terminal members are annular and include electrically conductive inner peripheries coaxially arranged symmetrically about a longitudinal axis, the inside diameter of the inner periphery of one terminal member being between two and three times the diameter of the inner periphery of the other terminal member, an annular groove formed in said other terminal member coaxially radially spaced from the inner periphery of said other terminal member, said movable bridge member is slidably mounted on the inner periphery of said one terminal member in electrically conductive relation thereto, said movable contact means includes a contact button mounted on said bridge member and movable therewith and a contact assembly slidably journaled in electrically conductive relation on the inner periphery of said other terminal, said movable bridge member sealingly engaging the inner periphery of said one terminal member and dividing the interior of said envelope into first and second pressurizable chambers, said annular groove, said contact button mounted on the bridge member, said movable contact assembly and a portion of said movable bridge member being within one of said chambers, and port means communicating with each chamber for selectively admitting and releasing fluid under pressure therefrom to control movement of said movable bridge member and said movable contact means whereby an initial predetermined limited movement of said bridge member in a switch "closing" direction effects electrically conductive contact between said contact button on the bridge member and the complementary contact button on the movable contact assembly to make a circuit between said terminal members and whereby continued movement of the bridge member in a switch "closing" direction effects movement of the movable contact means and engagement in an electrically conductive relationship of said bridge member with said annular groove formed in said other terminal member to enhance the current carrying capacity of the switch.

18. The combination according to claim 2, in which said contact bars are integrally interconnected at corresponding opposite ends to longitudinally extending metallic edge strips, each opposite edge strip being angularly disposed in relation to the longitudinal dimension of the contact bars to define therewith a shallow channel of which the contact bars form the bottom and said edge strips form the sides.

19. The combination according to claim 3, in which said terminal members are annular to provide inner peripheries, a multiplicity of said contact bars are an integral part of an elongated contact strip forming a set thereof, at least one such contact strip forming a set mounted on the inner periphery of each terminal member, and said bridge member and movable contact means include portions electrically conductively engaging associated contact bars.

20. The combination according to claim 5, in which said contact bars are integrally interconnected at corresponding opposite ends to longitudinally extending metallic edge strips, each said contact bar being rotationally displaced about its longitudinal axis to place opposite lateral edges of each contact bar in spaced parallel planes whereby application of a compressive force on said opposite lateral edges resiliently displaces the contact bar.

21. The combination according to claim 8, in which said movable contact means completes said auxiliary conductive path through said switch prior to completion of said primary conductive path through the switch.

22. The combination according to claim 10, in which said contact bars electrically conductively and resiliently engage the outer peripheries of said bridge member and said movable contact means when said switch is in "closed" condition.

23. The combination according to claim 12, in which said bridge member and said movable contact means when in switch "closed" position establish primary and auxiliary conductive paths through the switch, and electrical circuits through said primary and auxiliary conductive paths are completed and broken in one of said pressurizable chambers.

24. In an electric switch structure incorporating a hollow envelope symmetrical about a longitudinal axis and defined by electrically conductive axially spaced and aligned first and second terminal members held apart by a dielectric sleeve sealingly interposed between said terminal members, the combination comprising:

(a) a piston-like bridge member having an electrically conductive outer periphery slidably mounted in electrically conductive engagement on said second terminal member for selective movement in one direction to span the space between said terminal members and selectively movable in the opposite direction to re-establish the space between said terminal members and with said terminal members and said dielectric sleeve defining first and second pressurizable chambers within said envelope which may be selectively pressurized to effect movement of said piston-like bridge member;

(b) means resiliently interposed between said piston-like bridge member and said terminal members imposing a retarding force against axial movement of said bridge member in either direction;

(c) a movable contact assembly slidably mounted on said first terminal member and including a sleeve resiliently biased toward said piston-like bridge member and having an outer periphery in electrically conductive engagement with said first terminal member and a contact button mounted on the sleeve selectively engageable and dis-engageable by said piston-like bridge member in response to selective movement thereof;

(d) means resiliently interposed between said movable contact assembly and said first terminal member imposing a retarding force against axial movement of said movable contact assembly in either direction; and (e) means associated with said terminal members for selectively admitting high pressure fluid to said first and second chambers to effect movement of said bridge member in a selected axial direction.

25. The combination according to claim 24, in which said means resiliently interposed between said piston-like bridge member and said second terminal member imposes a rotary moment on said bridge member to effect incremental rotation thereof when moved from one extreme to the other.

26. The combination according to claim 24, in which said piston-like bridge member comprises an elongated electrically conductive tubular member having an electrically conductive transverse wall extending diametrically thereacross adjacent the end thereof remote from said first terminal member.

27. The combination according to claim 24, in which said first terminal member is associated with said first pressurizable chamber, said second terminal is associated with said second pressurizable chamber, and "make" and "break" functions are effected in said first chamber.

28. The combination according to claim 24, in which said first and second terminal members are annular to provide inner peripheries, and said means resiliently interposed between said piston-like bridge member and said second terminal member comprises an elongated electrically conductive metallic strip circumferentially mounted on the inner periphery of the second terminal member and having a multiplicity of integral resilient contact bars extending transversally across the metallic strip and longitudinally of said envelope, each resilient contact bar presenting one edge portion resiliently impinging against the inner periphery of the associated terminal member and the other edge resiliently impinging against the outer periphery of said bridge member.

29. The combination according to claim 24, in which said first and second terminal members are annular to provide inner peripheries, and said means resiliently interposed between said movable contact assembly and said first terminal member comprises an elongated electrically conductive metallic strip circumferentially mounted on the inner periphery of said first terminal member and having a multiplicity of integral resilient contact bars extending transversally across the metallic strip and longitudinally of said envelope, each resilient contact bar presenting one edge portion resiliently impinging against the inner periphery of said first terminal member and the other edge resiliently impinging against the outer periphery of said movable contact assembly.

30. The combination according to claim 24, in which said movable contact assembly includes an electrically conductive wall extending diametrically across said sleeve adjacent the end thereof associated with said piston-like bridge member to form recesses on opposite sides of said wall, said contact button is mounted on said wall within one recess, spring means are mounted on the terminal member to extend into the other recess and impinge against said wall to resiliently bias said sleeve toward said bridge member, and a contact button on said bridge member engageable with the contact button on said movable contact assembly to complete a circuit through the switch.

31. The combination according to claim 24, in which said first and second terminal members are annular to provide inner peripheries coaxially arranged about said longitudinal axis, and said terminal members are provided with inner end surfaces in substantial transverse alignment and terminating in said first pressurizable chamber.

32. The combination according to claim 24, in which said first and second terminal members are annular to provide inner peripheries coaxially arranged about said longitudinal axis, said piston-like bridge member comprises an elongated electrically conductive tubular member having an electrically conductive transverse wall extending diametrically thereacross adjacent the end thereof remote from said first terminal member, said bridge member when positioned in a switch "open" position being contained within the inner periphery of said second terminal member and when positioned in an intermediate position whereby said bridge member and said movable contact assembly are electrically engaged, said second terminal, a portion of said tubular member of the bridge member and said conductive transverse wall cooperate to form a path to carry electric current in a direction reversed to the direction of current flow through said movable contact assembly whereby the magnetic field generated by current flowing through said moveable contact assembly is nullified by the magnetic field generated by the current flowing through said tubular member of the bridge member.

33. The combination according to claim 24, in which said first and second terminal members are annular to provide inner peripheries coaxially arranged about said longitudinal axis, the diameter of the inner periphery of said first terminal being substantially less than the diameter of the inner periphery of the second terminal member, said movable contact assembly extends into said second terminal member, and said piston-like bridge member includes a tubular portion extending into said first chamber and circumscribing said movable contact assembly in coaxially spaced relation.

34. The combination according to claim 25, in which means are provided on the inner periphery of said second terminal cooperating with said means resiliently interposed between said piston-like bridge member and said second terminal member to effect relaxation of the resiliently stressed means.

35. The combination according to claim 26, in which seal means are provided about said piston-like bridge member cooperating with the inner periphery of the associated terminal member to form a fluid tight slidable union therebetween, and a contact button centrally disposed on said electrically conductive transverse wall and engageable and disengageable from said movable contact assembly in response to movement of said bridge member.

36. The method of operating an electric switch structure incorporating a hollow envelope defined by electrically conductive axially spaced first and second terminal members held apart by a dielectric sleeve sealingly interposed between said terminal members, and a piston-like bridge member slidably disposed within the envelope for movement between said terminal members and defining first and second chambers therewithin and a resiliently biased movable contact assembly slidably mounted within one of the chambers for engagement and disengagement from said bridge member, comprising the steps of:

(a) admitting a fluid under pressure to said first and second chambers; and thereafter selectively (b) controlling the pressure of fluid in each chamber to provide a pressure differential therebetween sufficient to effect movement of said bridge member in a direction to "open" or "close" said switch.

37. The method according to claim 36, in which the pressure of fluid in each chamber is controlled to reduce the pressure in one chamber while simultaneously increasing the pressure in the other chamber to establish said differential pressure to effect movement of said piston-like bridge member.

* * * * *